US011671752B2

(12) United States Patent
Kim et al.

(10) Patent No.: US 11,671,752 B2
(45) Date of Patent: Jun. 6, 2023

(54) AUDIO ZOOM

(71) Applicant: QUALCOMM Incorporated, San Diego, CA (US)

(72) Inventors: Lae-Hoon Kim, San Diego, CA (US); Fatemeh Saki, San Diego, CA (US); Yoon Mo Yang, San Diego, CA (US); Erik Visser, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 22 days.

(21) Appl. No.: 17/316,529

(22) Filed: May 10, 2021

(65) Prior Publication Data

US 2022/0360891 A1 Nov. 10, 2022

(51) Int. Cl.

| | |
|---|---|
| ***H04R 1/40*** | (2006.01) |
| ***H04R 1/24*** | (2006.01) |
| ***H04R 5/033*** | (2006.01) |
| ***H04R 5/04*** | (2006.01) |

(52) U.S. Cl.

CPC ..... *H04R 1/406* (2013.01); *H04R 1/245* (2013.01); *H04R 5/033* (2013.01); *H04R 5/04* (2013.01)

(58) Field of Classification Search

None

See application file for complete search history.

(56) References Cited

U.S. PATENT DOCUMENTS

| | | | |
|---|---|---|---|
| 2007/0280486 | A1 | 12/2007 | Buck et al. |
| 2011/0129095 | A1 | 6/2011 | Avendano et al. |
| 2014/0003622 | A1* | 1/2014 | Ikizyan ..... G10L 19/008 381/95 |
| 2014/0064514 | A1 | 3/2014 | Mikami et al. |
| 2014/0362253 | A1 | 12/2014 | Kim et al. |
| 2017/0127175 | A1 | 5/2017 | Sanders |
| 2018/0122373 | A1 | 5/2018 | Garner |
| 2019/0246218 | A1 | 8/2019 | Hertzberg et al. |

(Continued)

FOREIGN PATENT DOCUMENTS

| | | | |
|---|---|---|---|
| JP | H03245699 | A | 11/1991 |
| JP | 2016039632 | A | 3/2016 |

OTHER PUBLICATIONS

JP 2016039632 A English machine translation (Year: 2016).*

(Continued)

*Primary Examiner* — James K Mooney
(74) *Attorney, Agent, or Firm* — Moore IP

(57) ABSTRACT

A device includes one or more processors configured to execute instructions to determine a first phase based on a first audio signal of first audio signals and to determine a second phase based on a second audio signal of second audio signals. The one or more processors are also configured to execute the instructions to apply spatial filtering to selected audio signals of the first audio signals and the second audio signals to generate an enhanced audio signal. The one or more processors are further configured to execute the instructions to generate a first output signal including combining a magnitude of the enhanced audio signal with the first phase and to generate a second output signal including combining the magnitude of the enhanced audio signal with the second phase. The first output signal and the second output signal correspond to an audio zoomed signal.

35 Claims, 12 Drawing Sheets

(56) References Cited

U.S. PATENT DOCUMENTS

2020/0409995 A1 12/2020 Sheaffer et al.

OTHER PUBLICATIONS

Partial International Search Report—PCT/US2022/072218—ISA/EPO—dated Sep. 16, 2022.
Cheung P., "Lecture 8: Frequency Responses of a System", Department of Electrical & Electronic Engineering, Imperial College London, DE2—Electronics 2, Feb. 8, 2021, 11 pages.
International Search Report and Written Opinion—PCT/US2022/072218—ISA/EPO—dated Dec. 19, 2022.

* cited by examiner

AUDIO ZOOM

I. FIELD

The present disclosure is generally related to performing audio zoom.

II. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

Such computing devices often incorporate functionality to receive an audio signal from one or more microphones. For example, the audio signal may represent user speech captured by the microphones, external sounds captured by the microphones, or a combination thereof. The captured sounds can be played back to a user of such a device. However, some of the captured sounds that the user may be interested in listening to may be difficult to hear because of other interfering sounds.

III. SUMMARY

According to one implementation of the present disclosure, a device includes a memory and one or more processors. The memory is configured to store instructions. The one or more processors are configured to execute the instructions to determine a first phase based on a first audio signal of first audio signals and to determine a second phase based on a second audio signal of second audio signals. The one or more processors are also configured to execute the instructions to apply spatial filtering to selected audio signals of the first audio signals and the second audio signals to generate an enhanced audio signal. The one or more processors are further configured to execute the instructions to generate a first output signal including combining a magnitude of the enhanced audio signal with the first phase. The one or more processors are also configured to execute the instructions to generate a second output signal including combining the magnitude of the enhanced audio signal with the second phase. The first output signal and the second output signal correspond to an audio zoomed signal. According to another implementation of the present disclosure, a method includes determining, at a device, a first phase based on a first audio signal of first audio signals. The method also includes determining, at the device, a second phase based on a second audio signal of second audio signals. The method further includes applying, at the device, spatial filtering to selected audio signals of the first audio signals and the second audio signals to generate an enhanced audio signal. The method also includes generating, at the device, a first output signal including combining a magnitude of the enhanced audio signal with the first phase. The method further includes generating, at the device, a second output signal including combining the magnitude of the enhanced audio signal with the second phase. The first output signal and the second output signal correspond to an audio zoomed signal.

According to another implementation of the present disclosure, a non-transitory computer-readable medium includes instructions that, when executed by one or more processors, cause the one or more processors to determine a first phase based on a first audio signal of first audio signals and to determine a second phase based on a second audio signal of second audio signals. The instructions, when executed by the one or more processors, also cause the one or more processors to apply spatial filtering to selected audio signals of the first audio signals and the second audio signals to generate an enhanced audio signal. The instructions, when executed by the one or more processors, further cause the one or more processors to generate a first output signal including combining a magnitude of the enhanced audio signal with the first phase. The instructions, when executed by the one or more processors, also cause the one or more processors to generate a second output signal including combining the magnitude of the enhanced audio signal with the second phase. The first output signal and the second output signal correspond to an audio zoomed signal. According to another implementation of the present disclosure, an apparatus includes means for determining a first phase based on a first audio signal of first audio signals. The apparatus also includes means for determining a second phase based on a second audio signal of second audio signals. The apparatus further includes means for applying spatial filtering to selected audio signals of the first audio signals and the second audio signals to generate an enhanced audio signal. The apparatus also includes means for generating a first output signal including combining a magnitude of the enhanced audio signal with the first phase. The apparatus further includes means for generating a second output signal including combining the magnitude of the enhanced audio signal with the second phase. The first output signal and the second output signal correspond to an audio zoomed signal.

Other aspects, advantages, and features of the present disclosure will become apparent after review of the entire application, including the following sections: Brief Description of the Drawings, Detailed Description, and the Claims.

IV. BRIEF DESCRIPTION OF THE DRAWINGS

V. DETAILED DESCRIPTION

Figure 1:
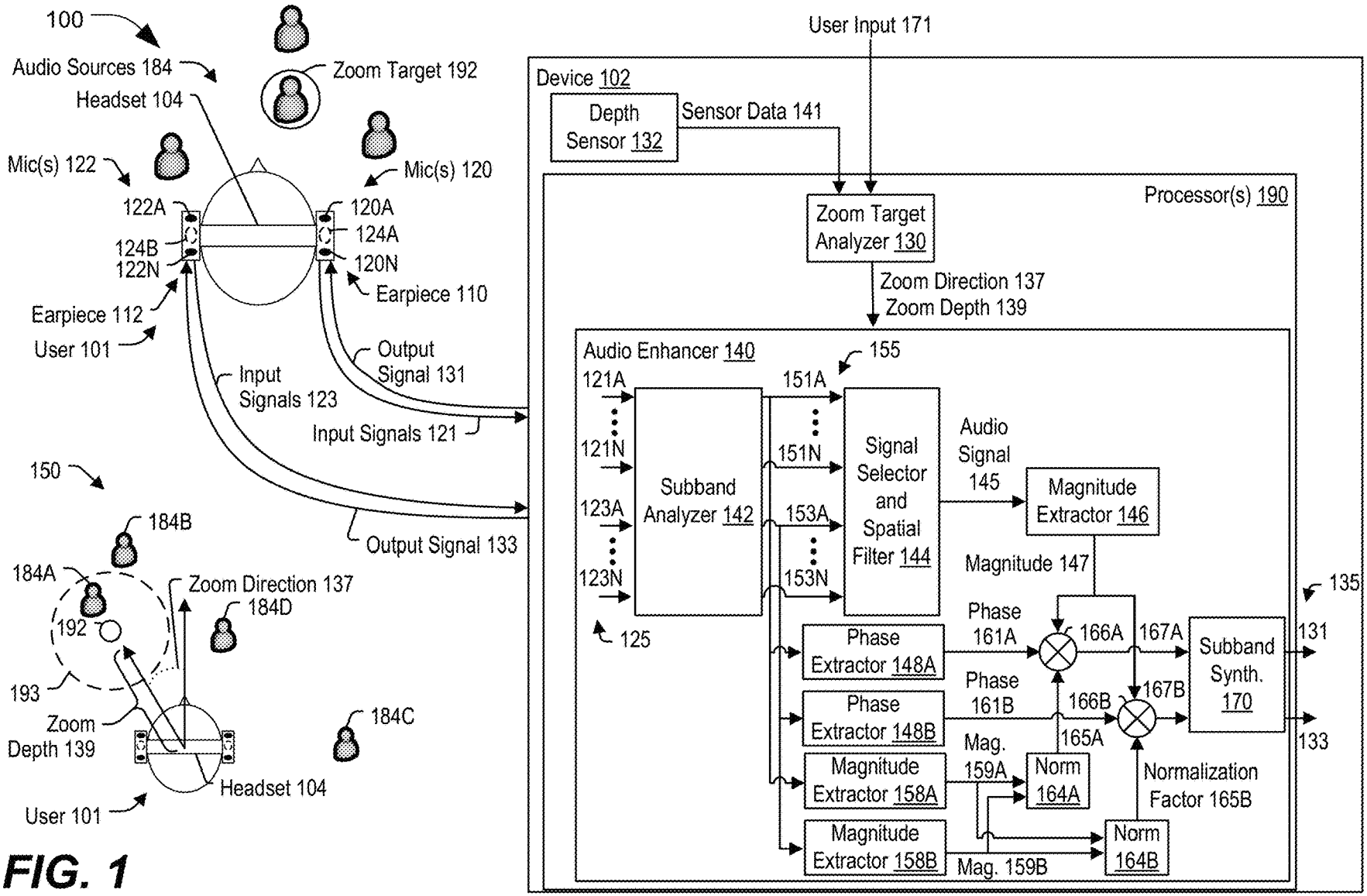
FIG. 1 is a block diagram of a particular illustrative aspect of a system operable to perform audio zoom, in accordance with some examples of the present disclosure.

External microphones on a device such as a headset may capture external sounds that are passed through to a user wearing the headset. Some of the captured sounds that are of interest to the user may be difficult to hear because of other interfering sounds that are also captured by the external microphones. The experience of the user in listening to the sounds of interest can therefore be negatively impacted by the presence of the interfering sounds.

Systems and methods of performing audio zoom are disclosed. In an illustrative example, an audio enhancer receives left input signals from microphones that are mounted externally to a left earpiece of a headset and right input signals from microphones that are mounted externally to a right earpiece of the headset. The audio enhancer receives a user input indicating a zoom target. The audio enhancer selects, based at least in part on the zoom target, input signals from the left input signals and the right input signals. The audio enhancer performs, based at least in part on the zoom target, spatial filtering on the selected input signals to generate an enhanced audio signal (e.g., an audio zoomed signal). For example, the enhanced audio signal corresponds to amplification (e.g., higher gain) applied to input signals associated with an audio source corresponding to the zoom target, attenuation (e.g., lower gain) applied to input signals associated with the remaining audio sources, or both.

In some implementations, the audio enhancer modifies the enhanced audio signal for playout at each of the earpieces by adjusting a magnitude and phase of the enhanced audio signal based on input signals from microphones at the respective earpieces. In an illustrative example, the audio enhancer determines a left normalization factor and a right normalization factor corresponding to a relative difference between a magnitude of a representative one of the left input signals and a magnitude of a representative one of the right input signals. The audio enhancer generates a left output signal by combining a left normalized magnitude of the enhanced audio signal with a phase of one of the left input signals. The audio enhancer also generates a right output signal by combining a right normalized magnitude of the enhanced audio signal with a phase of the representative right input signal. The audio enhancer provides the left output signal to a speaker of the left earpiece and the right output signal to a speaker of the right earpiece.

Using the normalization factors maintains a relative difference in magnitudes of the left output signal and the right output signal to be similar to the relative difference between the magnitude of the representative left input signal and the magnitude of the right input signal. Using the same phases for the left output signal and the right output signal as the representative left input signal and the representative right input signal, respectively, maintains the phase difference between the left output signal and the right output signal. Maintaining the phase difference and the magnitude difference maintains the overall binaural sensation for the user listening to the output signals. For example, maintaining the phase difference and the magnitude difference preserves the directionality and relative distance of the zoomed audio source. If the audio source is to the right of the user, the sound from the audio source arrives at the right microphones earlier than at the left microphones (as indicated by the phase difference), and if the audio source is closer to the right ear than to the left ear, the sound from the audio source is louder as captured by the right microphones than by the left microphones (as indicated by the magnitude difference).

In audio zoom techniques that do not maintain the phase difference and the magnitude difference, the original spatial auditory scene would be lost and would provide a mono-like or stereo-like user experience. For example, the audio zoom techniques that use amplification to zoom to an audio source may enable the user to perceive the audio source as louder but, without maintaining the phase difference and the magnitude difference, the directionality information and the relative distance of the audio source would be lost. To illustrate, if a visually-impaired pedestrian is using the headset at a noisy intersection to perform an audio zoom to an audible "walk/don't walk" traffic signal, the pedestrian relies on the directionality information and the relative distance to distinguish whether the street in front or the street on the left is being signaled as safe to cross. In another example, if the headset audio zooms to the sound of an ambulance, the user relies on the directionality information and the relative distance to determine the direction and closeness of the ambulance.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. Further, some features described herein are singular in some implementations and plural in other implementations. To illustrate, FIG. 1 depicts a device 102 including one or more processors ("processor(s)" 190 of FIG. 1), which indicates that in some implementations the device 102 includes a single processor 190 and in other implementations the device 102 includes multiple processors 190.

As used herein, the terms "comprise," "comprises," and "comprising" may be used interchangeably with "include," "includes," or "including." Additionally, the term "wherein" may be used interchangeably with "where." As used herein, "exemplary" indicates an example, an implementation, and/or an aspect, and should not be construed as limiting or as indicating a preference or a preferred implementation. As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

Unless stated otherwise, as used herein, "coupled" may include "communicatively coupled," "electrically coupled," or "physically coupled," and may also (or alternatively) include any combinations thereof. Two devices (or components) may be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled may be included in the same device or in different devices and may be connected via electronics, one or more connectors, or inductive coupling, as illustrative, non-limiting examples. In some implementations, two devices (or components) that are communicatively coupled, such as in electrical communication, may send and receive signals (e.g., digital signals or analog signals) directly or indirectly, via one or more wires, buses, networks, etc. As used herein, "directly coupled" may include two devices that are coupled (e.g., communicatively coupled, electrically coupled, or physically coupled) without intervening components. Unless stated otherwise, two device (or components) that are "coupled," may be directly and/or indirectly coupled.

In the present disclosure, terms such as "determining," "calculating," "estimating," "shifting," "adjusting," etc. may be used to describe how one or more operations are performed. It should be noted that such terms are not to be construed as limiting and other techniques may be utilized to perform similar operations. Additionally, as referred to herein, "generating," "calculating," "estimating," "using," "selecting," "accessing," and "determining" may be used interchangeably. For example, "generating," "calculating," "estimating," or "determining" a parameter (or a signal) may refer to actively generating, estimating, calculating, or determining the parameter (or the signal) or may refer to using, selecting, or accessing the parameter (or signal) that is already generated, such as by another component or device.

Referring to FIG. 1, a particular illustrative aspect of a system configured to perform audio zoom is disclosed and generally designated 100. The system 100 includes a device 102. In a particular aspect, the device 102 is configured to be coupled to a headset 104.

The headset 104 includes an earpiece 110 (e.g., a right earpiece), an earpiece 112 (e.g., a left earpiece), or both. In a particular example, the earpiece 110 is configured to at least partially cover one ear of a wearer of the headset 104 and the earpiece 112 is configured to at least partially cover the other ear of the wearer of the headset 104. In a particular example, the earpiece 110 is configured to be placed at least partially in one ear of a wearer of the headset 104 and the earpiece 112 is configured to be placed at least partially in the other ear of the wearer of the headset 104.

The earpiece 110 includes one or more microphones (mic(s)) 120, such as a microphone 120A, one or more additional microphones, a microphone 120N, or a combination thereof. The one or more microphones 120 mounted in a linear configuration on the earpiece 110 is provided as an illustrative example. In other examples, the one or more microphones 120 can be mounted in any configuration (e.g., linear, partially linear, rectangular, t-shaped, s-shaped, circular, non-linear, or a combination thereof) on the earpiece 110. The earpiece 110 includes one or more speakers 124, such as a speaker 124A. The earpiece 110 including one speaker is provided as an illustrative example. In other examples, the earpiece 110 can include more than one speaker. In a particular aspect, the one or more microphones 120 are mounted externally on the earpiece 110, the speaker 124A is internal to the earpiece 110, or both. For example, the speaker 124A is mounted on a surface of the earpiece 110 that is configured to be placed at least partially in an ear of a wearer of the headset 104, to face the ear of the wearer of the headset 104, or both. In a particular example, the one or more microphones 120 are mounted on a surface of the earpiece 110 that is configured to be facing away from the ear of the wearer of the headset 104. To illustrate, the one or more microphones 120 are configured to capture external sounds that can be used for noise cancelation or passed through to a wearer of the headset 104. For example, the one or more microphones 120 are configured to capture sounds from one or more audio sources 184. As an illustrative non-limiting example, the one or more audio sources 184 include a person, an animal, a speaker, a device, waves, wind, leaves, a vehicle, a robot, a machine, a musical instrument, or a combination thereof. The speaker 124A is configured to output audio to the wearer of the headset 104.

Similarly, the earpiece 112 includes one or more microphones (mic(s)) 122, such as a microphone 122A, one or more additional microphones, a microphone 122N, or a combination thereof. The one or more microphones 122 mounted in a linear configuration on the earpiece 112 is provided as an illustrative example. In other examples, the one or more microphones 122 can be mounted in any configuration on the earpiece 112. The earpiece 112 includes one or more speakers, such as a speaker 124B. In a particular aspect, the one or more microphones 122 are mounted externally on the earpiece 112, the speaker 124B is internal to the earpiece 112, or both. The speaker 124A and the speaker 124B are illustrated using dashed lines to indicate internal components that are not generally visible externally of headset 104.

The device 102 is depicted as external to the headset 104 as an illustrative example. In other implementations, one or more (or all) components of the device 102 are integrated in the headset 104. The device 102 is configured to perform audio zoom using an audio enhancer 140. The device 102 includes one or more processors 190 that include a zoom target analyzer 130, the audio enhancer 140, or both. In a particular aspect, the one or more processors 190 are coupled to a depth sensor 132 (e.g., an ultrasound sensor, a stereo camera, a time-of-flight sensor, an antenna, a position sensor, or a combination thereof). In a particular example, the depth sensor 132 is integrated in the device 102. In some implementations, the depth sensor 132 is integrated in the headset 104 or another device that is external to the device 102.

The zoom target analyzer 130 is configured to receive a user input 171 indicating a zoom target 192 and to determine a zoom direction 137, a zoom depth 139, or both, of the zoom target 192 relative to the headset 104. An example 150 indicates a zoom direction 137 (e.g., "30 degrees"), a zoom depth 139 (e.g., "8 feet"), or both, of the zoom target 192 from a center of the headset 104 in the horizontal plane. In a particular aspect, performing the audio zoom simulates moving the headset 104 from a location of the user 101 to a location of the zoom target 192. In a particular aspect, an audio source 184A and an audio source 184B (e.g., people sitting at a table across the room) are closer to the zoom target 192 than to the user 101, and an audio source 184C (e.g., another person sitting at the next table) is closer to the user 101 than to the zoom target 192. In a particular aspect, the simulated movement of the headset 104 from the location of the user 101 to the location of the zoom target 192 is perceived by the user 101 as zooming closer to the audio source 184A and the audio source 184B (e.g., the people sitting at the table across the room), zooming away from the audio source 184C (e.g., the person sitting at the next table), or both.

In a particular example, an audio source 184D is equidistant from the user 101 and the zoom target 192. In a particular aspect, the simulated movement of the headset 104 from the location of the user 101 to the location of the zoom target 192 is perceived by the user 101 as no zoom applied to the audio source 184D.

In a particular aspect, the audio zoom corresponds to a focus applied to the zoom target 192. For example, sounds from any audio sources (e.g., the audio sources 184B-D) that are outside a threshold distance 193 of the zoom target 192 are reduced. In this example, the simulated movement of the headset 104 from the location of the user 101 to the location of the zoom target 192 is perceived by the user as zooming towards the audio source 184A, and zooming away from the audio sources 184B-D. In a particular example, the zoom direction 137 is based on a first direction in the horizontal plane, a second direction in the vertical plane, or both, of the zoom target 192 from the center of the headset 104. Similarly, in a particular example, the zoom distance 139 is based on a first distance in the horizontal plane, a second distance in the vertical plane, or both, of the zoom target 192 from the center of the headset 104.

The audio enhancer 140 includes a subband analyzer 142 coupled via a signal selector and spatial filter 144 to a magnitude extractor 146. The subband analyzer 142 is also coupled to a plurality of phase extractors 148 (e.g., as a phase extractor 148A and a phase extractor 148B) and to a plurality of magnitude extractors 158 (e.g., a magnitude extractor 158A and a magnitude extractor 158B). Each of the plurality of magnitude extractors 158 is coupled to a normalizer 164. For example, the magnitude extractor 158A is coupled to a normalizer (norm) 164A, and the magnitude extractor 158B is coupled to a norm 164B. Each of the magnitude extractor 146, the norm 164A, and the phase extractor 148A is coupled via a combiner 166A to a subband synthesizer 170. Each of the magnitude extractor 146, the phase extractor 148B, and the norm 164B is coupled via a combiner 166B to the subband synthesizer 170.

The subband analyzer 142 is configured to receive input signals 125, via one or more interfaces, from the headset 104. The subband analyzer 142 is configured to generate audio signals 155 by transforming the input signals 125 from the time-domain to the frequency-domain. For example, the subband analyzer 142 is configured to apply a transform (e.g., a fast Fourier transform (FFT)) to each of the input signals 125 to generate a corresponding one of the audio signals 155.

The signal selector and spatial filter 144 is configured to perform spatial filtering on selected pairs of the audio signals 155 to generate spatially filtered audio signals, and to output one of the spatially filtered audio signals as an audio signal 145, as further described with reference to FIG. 2. In a particular aspect, the audio signal 145 corresponds to an enhanced audio signal (e.g., a zoomed audio signal in which some audio sources are amplified, other audio sources are attenuated, or both, such as described above for the example 150). The audio signal 145 is received by the magnitude extractor 146, which is configured to determine a magnitude 147 of the audio signal 145.

One of the audio signals 151 associated with the one or more microphones 120 (e.g., the right microphones) is provided to each of the phase extractor 148A and the magnitude extractor 158A to generate a phase 161A and a magnitude 159A, respectively. In a particular aspect, the phase 161A and the magnitude 159A correspond to a representative phase and a representative magnitude of sounds received by one of the microphones 120 (e.g., a selected one of the right microphones).

One of the audio signals 153 associated with the one or more microphones 122 (e.g., the left microphones) is provided to each of the phase extractor 148B and the magnitude extractor 158B to generate a phase 161B and magnitude 159B, respectively. In a particular aspect, the phase 161B and the magnitude 159B correspond to a representative phase and a representative magnitude of sounds received by the one of the microphones 122 (e.g., a selected one of the left microphones).

The norm 164A is configured to generate a normalization factor 165A based on the magnitude 159A and the magnitude 159B (e.g., normalization factor 165A=magnitude 159A/(max (magnitude 159A, magnitude 159B))). The norm 164B is configured to generate a normalization factor 165B based on the magnitude 159A and the magnitude 159B (e.g., normalization factor 165B=magnitude 159B/(max (magnitude 159A, magnitude 159B))). The combiner 166A is configured to generate an audio signal 167A based on the normalization factor 165A, the magnitude 147, and the phase 161A. The combiner 166B is configured to generate an audio signal 167B based on the normalization factor 165B, the magnitude 147, and the phase 161B.

Using the normalization factors 165 to generate the audio signals 167 enables maintaining the difference in the magnitude of the audio signals 167. For example, the difference between (e.g., a ratio of) the magnitude of the audio signal 167A and the magnitude of the audio signal 167B is the same as the difference between (e.g., a ratio of) the magnitude 159A (e.g., representative of the sounds captured by the one or more microphones 120) and the magnitude 159B (e.g., representative of the sounds captured by the one or more microphones 122).

Using the phases 161 to generate the audio signals 167 enables maintaining the difference in the phase of the audio signals 167. For example, the audio signal 167A has the phase 161A (e.g., representative of the sounds captured by the one or more microphones 120) and the audio signal 167B has the phase 161B (e.g., representative of the sounds captured by the one or more microphones 122).

The subband synthesizer 170 is configured to generate output signals 135 by transforming the audio signals 167 from the frequency-domain to the time-domain. For example, the subband analyzer 142 is configured to apply a transform (e.g., an inverse FFT) to each of the audio signals 167 to generate a corresponding one of the output signals 135. In a particular aspect, the audio enhancer 140 is configured to provide the output signals 135 to the one or more speakers 124 of the headset 104.

In some implementations, the device 102 corresponds to or is included in one or various types of devices. In an illustrative example, the one or more processors 190 are integrated in the headset 104, such as described further with reference to FIG. 10. In other examples, the one or more processors 190 are integrated in a virtual reality headset or an augmented reality headset, as described with reference to FIG. 11. In another illustrative example, the one or more processors 190 are integrated into a vehicle that also includes the one or more microphones 120, the one or more microphones 122, or a combination thereof, such as described further with reference to FIG. 8.

During operation, a user 101 wears the headset 104. The one or more microphones 120 and the one or more microphones 122 of the headset 104 capture sounds from the one or more audio sources 184. The zoom target analyzer 130 receives a user input 171 from the user 101. The user input 171 includes information indicative of how an audio zoom is to be performed. In various implementations, the user input 171 can include or indicate a selection of a particular target (e.g., an audio source 184, a location, or both), a selection to adjust the audio in a manner that simulates moving the headset 104, or a combination thereof. For example, the user input 171 can include a user's selection of the particular target and a zoom depth 139 indicating how much closer to the particular target the headset 104 should be perceived as being located (e.g., 2 feet).

In a particular aspect, the user input 171 includes (or indicates) an audio input, an option selection, a graphical user interface (GUI) input, a button activation/deactivation, a slide input, a touchscreen input, a user tap detected via a touch sensor of the headset 104, a movement of the headset 104 detected by a movement sensor of the headset 104, a keyboard input, a mouse input, a touchpad input, a camera input, a user gesture input, or a combination thereof. For example, the user input 171 indicates an audio source (e.g., zoom to "Sammi Dar," "guitar," or "bird"), the zoom depth 139 (e.g., zoom "10 feet"), the zoom direction 137 (e.g., zoom "forward," "in," "out," "right"), a location of the zoom target 192 (e.g., a particular area in a sound field), or a combination thereof. As an illustrative example, the user input 171 includes a user tap detected via a touch sensor of the headset 104 and corresponds to the zoom depth 139 (e.g., "zoom in 2 feet") and the zoom direction 137 (e.g., "forward"). In another example, a GUI depicts a sound field and the user input 171 includes a GUI input indicating a selection of a particular area of the sound field.

In some implementations, the zoom target analyzer 130, in response to determining that the user input 171 indicates a particular target (e.g., "Sammi Dar," "a guitar," or "stage"), detects the particular target by performing image analysis on camera input, sound analysis on audio input, location detection of a device associated with the particular target, or a combination thereof. In a particular implementation, the zoom target analyzer 130 designates the particular target or a location relative to (e.g., "closer to" or "halfway to") the particular target as the zoom target 192.

In a particular aspect, the zoom target analyzer 130 uses one or more location analysis techniques (e.g., image analysis, audio analysis, device location analysis, or a combination thereof) to determine a zoom direction 137, a zoom depth 139, or both, from the headset 104 to the zoom target 192. In an example, the zoom target analyzer 130 receives sensor data 141 from the depth sensor 132 (e.g., an ultrasound sensor, a stereo camera, an image sensor, a time-of-flight sensor, an antenna, a position sensor, or a combination thereof) and determines, based on the sensor data 141, the zoom direction 137, the zoom depth 139, or both, of the zoom target 192. To illustrate, in a particular example, the depth sensor 132 corresponds to an image sensor, the sensor data 141 corresponds to image data, and the zoom target analyzer 130 performs image recognition on the sensor data 141 to determine the zoom direction 137, the zoom depth 139, or both, to the zoom target 192. In another particular example, the depth sensor 132 corresponds to a position sensor and the sensor data 141 includes position data indicating a position of the zoom target 192. The zoom target analyzer 130 determines the zoom direction 137, the zoom depth 139, or both, based on the position of the zoom target 192. For example, the zoom target analyzer 130 determines the zoom direction 137, the zoom depth 139, or both, based on a comparison of the position of the zoom target 192 with a position, a direction, or both, of the headset 104.

In a particular aspect, the user input 171 indicates a zoom direction 137, a zoom depth 139, or both. The zoom target analyzer 130 designates the zoom target 192 as corresponding to the zoom direction 137, the zoom depth 139, or both in response to determining that the user input 171 (e.g., "zoom in") indicates the zoom direction 137 (e.g., "forward in the direction that the headset is facing" or "0 degrees"), the zoom depth 139 (e.g., a default value, such as 2 feet), or both.

The audio enhancer 140 receives the zoom direction 137, the zoom depth 139, or both, from the zoom target analyzer 130. The audio enhancer 140 also receives the input signals 121 from the earpiece 110, the input signals 123 from the earpiece 112, or a combination thereof.

The subband analyzer 142 generates audio signals 151 by applying a transform (e.g., FFT) to the input signals 121. For example, the subband analyzer 142 generates an audio signal 151A by applying a transform to the input signal 121A received from the microphone 120A. To illustrate, the input signal 121A corresponds to a time-domain signal that is converted to the frequency-domain to generate the audio signal 151A. As another example, the subband analyzer 142 generates an audio signal 151N by applying a transform to the input signal 121N received from the microphone 120N. Similarly, the subband analyzer 142 generates audio signals 153 by applying a transform (e.g., FFT) to the input signals 123. In a particular aspect, each of the audio signals 155 includes frequency subband information.

The subband analyzer 142 provides the audio signals 155 to the signal selector and spatial filter 144. The signal selector and spatial filter 144 processes (e.g., performs spatial filtering and signal selection on) the audio signals 155 based at least in part on the zoom direction 137, the zoom depth 139, position information of the one or more audio sources 184, the configuration of the one or more microphones 120, the configuration of the one or more microphones 122, or a combination thereof, to output an audio signal 145, as further described with reference to FIG. 2. In a particular aspect, the audio signal 145 corresponds to an enhanced audio signal (e.g., a zoomed audio signal). The signal selector and spatial filter 144 provides the audio signal 145 to the magnitude extractor 146. The magnitude extractor 146 outputs a magnitude 147 of the audio signal 145 (e.g., the zoomed audio signal) to each of the combiner 166A and the combiner 166B.

In a particular aspect, an audio signal is represented by $X(j\omega)=|X(j\omega)|e^{j<X(j\omega)}$, where $X(j\omega)$ corresponds to frequency response, $|X(j\omega)|$ corresponds to signal magnitude, and $<X(j\omega)$ corresponds to signal phase, in the frequency domain. In a particular aspect, each of the audio signals 155 contains magnitude and phase information for each of multiple frequency sub-bands.

Additionally, the subband analyzer 142 provides one of the audio signals 151 corresponding to the earpiece 110 to each of the phase extractor 148A and the magnitude extractor 158A, and provides one of the audio signals 153 corresponding to the earpiece 112 to each of the phase extractor 148B and the magnitude extractor 158B. For example, the subband analyzer 142 provides the audio signal 151A to each of the phase extractor 148A and the magnitude extractor 158A, and provides the audio signal 153A to each of the phase extractor 148B and the magnitude extractor 158B. In other examples, the subband analyzer 142 can instead provide another audio signal 151 corresponding to another microphone 120 to each of the phase extractor 148A and the magnitude extractor 158A and another audio signal 153 corresponding to another microphone 122 to each of the phase extractor 148B and the magnitude extractor 158B.

The phase extractor 148A determines a phase 161A of the audio signal 151A (or another representative audio signal 151) and provides the phase 161A to the combiner 166A. The phase extractor 148B determines a phase 161B of the audio signal 153A (or another representative audio signal 153) and provides the phase 161B to the combiner 166B. In a particular aspect, the phase 161A is indicated by first phase values and each of the first phase values indicates a phase of a corresponding frequency subband of the audio signal 151A (e.g., the representative audio signal 151). In a particular aspect, the phase 161B is indicated by second phase values and each of the second phase values indicates a phase of a corresponding frequency subband of the audio signal 153A (e.g., the representative audio signal 153).

The magnitude extractor 158A determines a magnitude 159A of the audio signal 151A (e.g., the representative audio signal 151) and provides the magnitude 159A to each of the norm 164A and the norm 164B. The magnitude extractor 158B determines a magnitude 159B of the audio signal 153A (e.g., the representative audio signal 153) and provides the magnitude 159B to each of the norm 164A and the norm 164B.

The norm 164A generates a normalization factor 165A based on the magnitude 159A and the magnitude 159B (e.g., normalization factor 165A=magnitude 159A/(max (magnitude 159A, magnitude 159B))), and provides the normalization factor 165A to the combiner 166A. The norm 164B is configured to generate a normalization factor 165B based on the magnitude 159A and the magnitude 159B (e.g., normalization factor 165B=magnitude 159B/(max (magnitude 159A, magnitude 159B))), and provides the normalization factor 165B to the combiner 166B.

In a particular aspect, the magnitude 159A is indicated by first magnitude values and each of the first magnitude values indicates a magnitude of a corresponding frequency subband of the audio signal 151A (e.g., the representative audio signal 151). In this aspect, the normalization factor 165A is indicated by first normalization factor values and each of the first normalization factor values indicates a normalization factor of a corresponding frequency subband of the audio signal 151A (e.g., the representative audio signal 151).

Similarly, in a particular aspect, the magnitude 159B is indicated by second magnitude values and each of the second magnitude values indicates a magnitude of a corresponding frequency subband of the audio signal 153A (e.g., the representative audio signal 153). In this aspect, the normalization factor 165B is indicated by second normalization factor values and each of the second normalization factor values indicates a normalization factor of a corresponding frequency subband of the audio signal 153A (e.g., the representative audio signal 153).

The combiner 166A generates an audio signal 167A based on the normalization factor 165A, the magnitude 147, and the phase 161A. For example, a magnitude of the audio signal 167A is represented by magnitude values that each indicate a magnitude of a corresponding frequency subband of the audio signal 167A. To illustrate, each of a first normalization factor value of the normalization factor 165A and a first magnitude value of the magnitude 147 corresponds to the same particular frequency subband. The combiner 166A determines a magnitude value corresponding the particular frequency subband of the audio signal 167A by applying the first normalization factor value to the first magnitude value. Similarly, the combiner 166B generates an audio signal 167B based on the normalization factor 165B, the magnitude 147, and the phase 161B.

In a particular aspect, applying the normalization factor 165A to the magnitude 147 and the normalization factor 165B to the magnitude 147 maintains the relative difference in magnitude of the audio signal 167A and the audio signal 167B same as (or similar to) the relative difference in magnitude of the audio signal 151A (representative of audio received by the one or more microphones 120) and the audio signal 153A (representative of audio received by the one or more microphones 122). Applying the phase 161A and 161B causes the relative phase difference between the audio signal 167A and the audio signal 167B to be the same as (or similar to) the relative phase difference between the audio signal 151A (representative of audio received by the one or more microphones 120) and the audio signal 153A (representative of audio received by the one or more microphones 122), respectively.

The subband synthesizer 170 generates output signals 135 based on the audio signal 167A and the audio signal 167B. For example, the subband synthesizer 170 generates an output signal 131 by applying a transform (e.g., inverse FFT (iFFT)) to the audio signal 167A and generates an output signal 133 by applying a transform (e.g., iFFT) to the audio signal 167B. To illustrate, the subband synthesizer 170 transforms the audio signal 167A and the audio signal 167B from the frequency-domain to the time-domain to generate the output signal 131 and output signal 133, respectively. In a particular aspect, the subband synthesizer 170 outputs the output signals 135 to the headset 104. For example, the subband synthesizer 170 provides the output signal 131 to the speaker 124A of the earpiece 110 and the output signal 133 to the speaker 124B of the earpiece 112. The output signals 135 correspond to an audio zoomed signal (e.g., a binaural audio zoomed signal).

The system 100 enables providing audio zoom while preserving the overall binaural sensation for the user 101 listening to the output signals 135. For example, the overall binaural sensation is preserved by maintaining the phase difference and the magnitude difference between the output signal 131 output by the speaker 124A and the output signal 133 output by the speaker 124B. The phase difference is maintained by generating the output signal 131 based on the phase 161A of the audio signal 151A (e.g., a representative right input signal) and generating the output signal 133 based on the phase 161B of the audio signal 153A (e.g., a representative left input signal). The magnitude difference is maintained by generating the output signal 131 based on the normalization factor 165A and by generating the output signal 133 based on the normalization factor 165B. The directionality information and the relative distance is thus maintained. For example, if a visually-impaired pedestrian is using the headset at a noisy intersection to perform an audio zoom to an audible "walk/don't walk" traffic signal, the pedestrian can perceive the directionality and the relative distance to distinguish whether the street in front or the street on the left is being signaled as safe to cross. In another example, if the headset audio zooms to the sound of an ambulance, the user can perceive the directionality and the relative distance to determine the direction and closeness of the ambulance. In a particular aspect, extracting phase and magnitude of select signals and applying the phase and magnitude to preserve the directionality and relative distance is less computationally expensive as compared to applying a head-related impulse response (HRIR) or a head-related transfer function (HRTF), enabling the processors 190 to more efficiently generate binaural signals, as compared to using conventional techniques that would require more processing resources, higher power consumption, higher latency, or a combination thereof.

Although the one or more microphones 120, the one or more microphones 122, the speaker 124A, and the speaker 124B are illustrated as being coupled to the headset 104, in other implementations the one or more microphones 120, the one or more microphones 122, the speaker 124A, the speaker 124B, or a combination thereof, may be independent of a headset. In some implementations, the input signals 125 correspond to a playback file. For example, the audio enhancer 140 decodes audio data of a playback file to generate the input signals 125 (e.g., the input signals 121 and the input signals 123). In some implementations, the input signals 125 correspond to received streaming data. For example, a modem coupled to the one or more processors 190 provides audio data to the one or more processors 190 based on received streaming data, and the one or more processors 190 decode the audio data to generate the input signals 125.

In a particular example, the audio data includes position information indicating positions of sources (e.g., the one or more audio sources 184) of each of the input signals 125. In a particular aspect, the audio data includes a multi-channel audio representation corresponding to ambisonics data. For example, the multi-channel audio representation indicates configuration information of microphones (e.g., actual microphones or simulated microphones) that are perceived as having captured the input signals 125. The signal selector and spatial filter 144 generates the audio signal 145 based on the zoom direction 137, the zoom depth 139, the position information, the configuration information, or a combination thereof, as described with reference to FIG. 2.

Figure 2:
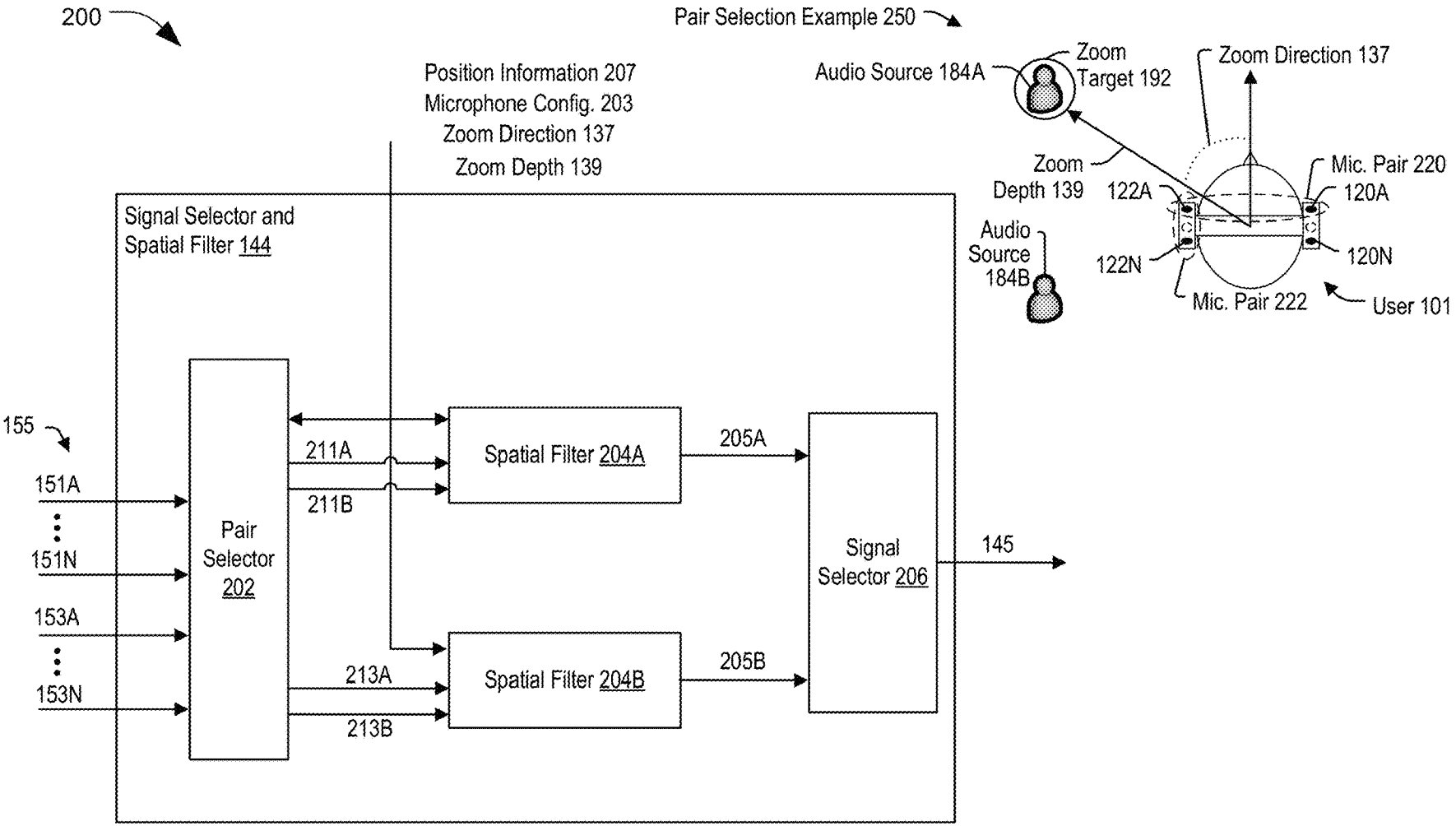
FIG. 2 is a diagram of an illustrative aspect of a signal selector and spatial filter of the illustrative system of FIG. 1, in accordance with some examples of the present disclosure.

Referring to FIG. 2, a diagram 200 of illustrative aspects of the signal selector and spatial filter 144 and a pair selection example 250 are shown. The signal selector and spatial filter 144 includes a pair selector 202 coupled via one or more spatial filters 204 (e.g., one or more adaptive beamformers) to a signal selector 206.

The pair selector 202 is configured to select a pair of the audio signals 155 for a corresponding spatial filter 204 based on the zoom direction 137, the zoom depth 139, position information 207 of the one or more audio sources 184, the microphone configuration 203 of the one or more microphones 120 and the one or more microphones 122, or a combination thereof. The position information 207 indicates a position (e.g., a location) of each of the one or more audio sources 184. For example, the position information 207 indicates that an audio source 184A has a first position (e.g., a first direction and a first distance) relative to a position of the headset 104 and that an audio source 184B has a second position (e.g., a second direction and a second distance) relative to a position of the headset 104. The microphone configuration 203 indicates a first configuration of the one or more microphones 120 (e.g., linearly arranged from front to back of the right earpiece) and a second configuration of the one or more microphones 122 (e.g., linearly arranged from front to back of the left earpiece).

In a particular implementation, the pair selector 202 has access to selection mapping data that maps the zoom direction 137, the zoom depth 139, the position information 207, the microphone configuration 203, or a combination thereof, to particular pairs of microphones. In the pair selection example 250, the selection mapping data indicates that the zoom direction 137, the zoom depth 139, the microphone configuration 203, the position information 207, or a combination thereof, map to a microphone pair 220 and a microphone pair 222. In a particular aspect, the microphone pair 220 includes a microphone 120A (e.g., a front-most microphone) of the one or more microphones 120 and a microphone 122A (e.g., a front-most microphone) of the one or more microphones 122. In a particular aspect, the microphone pair 222 includes the microphone 122A (e.g., the front-most microphone) of the one or more microphones 122 and a microphone 122N (e.g., a rear-most microphone) of the one or more microphones 122.

In a particular aspect, the selection mapping data is based on default data, a user input, a configuration setting, or a combination thereof. In a particular aspect, the audio enhancer 140 receives the selection mapping data from a second device that is external to the device 102, retrieves the selection mapping data from a memory of the device 102, or both. The pair selector 202 provides an audio signal 211A and an audio signal 211B corresponding to the microphone pair 220 to a spatial filter 204A (e.g., an adaptive beamformer) and an audio signal 213A and an audio signal 213B corresponding to the microphone pair 222 to a spatial filter 204B (e.g., an adaptive beamformer).

In the pair selection example 250, the microphone pair 220 includes the microphone 120A and the microphone 122A. The pair selector 202 provides the audio signal 151A (corresponding to the microphone 120A) as the audio signal 211A and the audio signal 153A (corresponding to the microphone 122A) as the audio signal 211B to the spatial filter 204A. Similarly, the microphone pair 222 includes the microphone 122A and the microphone 122N. The pair selector 202 provides the audio signal 153A (corresponding to the microphone 122A) as the audio signal 213A and the audio signal 153N (corresponding to the microphone 122N) as the audio signal 213B to the spatial filter 204B.

The spatial filters 204 apply spatial filtering (e.g., adaptive beamforming) to the selected audio signals (e.g., the audio signal 211A, the audio signal 211B, the audio signal 213A, and the audio signal 213B) to generate enhanced audio signals (e.g., audio zoomed signals). In a particular implementation, the spatial filter 204A applies a first gain to the audio signal 211A to generate a first gain adjusted signal and applies a second gain to the audio signal 211B to generate a second gain adjusted signal. The spatial filter 204A combines the first gain adjusted signal and the second gain adjusted signal to generate an audio signal 205A (e.g., an enhanced audio signal). Similarly, the spatial filter 204B applies a third gain to the audio signal 213A to generate a third gain adjusted signal and applies a fourth gain to the audio signal 213B to generate a fourth gain adjusted signal. The spatial filter 204B combines the third gain adjusted signal and the fourth gain adjusted signal to generate an audio signal 205B (e.g., an enhanced audio signal).

In a particular implementation, the spatial filters 204 apply spatial filtering with head shade effect correction. For example, the spatial filter 204A determines the first gain, the second gain, or both, based on a size of the head of the user 101, a movement of the head of the user 101, or both. As another example, the spatial filter 204B determines the third gain, the fourth gain, or both, based on the size of the head of the user 101, the movement of the head of the user 101, or both. In a particular example, a single one of the spatial filter 204A or the spatial filter 204B applies spatial filtering with head shade effect correction.

The spatial filters 204 apply the spatial filtering based on the zoom direction 137, the zoom depth 139, the microphone configuration 203, the position information 207, or a combination thereof. For example, the spatial filter 204A determines the first gain and the second gain based on the zoom direction 137, the zoom depth 139, the microphone configuration 203, the position information 207, or a combination thereof. To illustrate, the spatial filter 204A identifies, based on the zoom direction 137, the zoom depth 139, the microphone configuration 203, the position information 207, or a combination thereof, one of the audio signal 211A or the audio signal 211B as corresponding to a microphone that is closer to the zoom target 192. The spatial filter 204A applies a higher gain to the identified audio signal, a lower gain to the remaining audio signal, or both, during generation of the audio signal 205A. Similarly, the spatial filter 204B determines the third gain and the fourth gain based on the zoom direction 137, the zoom depth 139, the microphone configuration 203, the position information 207, or a combination thereof. For example, the spatial filter 204B identifies, based on the zoom direction 137, the zoom depth 139, the microphone configuration 203, the position information 207, or a combination thereof, one of the audio signal 213A or the audio signal 213B as corresponding to a microphone that is closer to the zoom target 192. The spatial filter 204B applies amplification (e.g., a higher gain) to the identified audio signal, attenuation (e.g., a lower gain) to the remaining audio signal, or both, during generation of the audio signal 205B.

In a particular implementation, the signal selector and spatial filter 144 applies the spatial filtering based on the zoom direction 137 and independently of receiving the zoom depth 139, the microphone configuration 203, the position information 207, or a combination thereof. For example, the pair selector 202 and the spatial filters 204 generate audio signals 205 corresponding to the zoom direction 137 and to various values of the zoom depth 139, the microphone configuration 203, the position information 207, or a combination thereof, and the signal selector 206 selects one of the audio signals 205 as the audio signal 145. In a particular aspect, selecting various values of the zoom depth 139 corresponds to performing autozoom, as further described with reference to FIG. 3.

In a particular implementation, the signal selector and spatial filter 144 applies the spatial filtering based on the zoom depth 139, and independently of receiving the zoom direction 137, the microphone configuration 203, the position information 207, or a combination thereof. For example, the pair selector 202 and the spatial filters 204 generate audio signals 205 corresponding to the zoom depth 139 and to various values of the zoom direction 137, the microphone configuration 203, the position information 207, or a combination thereof, and the signal selector 206 selects one of the audio signals 205 as the audio signal 145.

In a particular implementation, the signal selector and spatial filter 144 applies the spatial filtering based on the microphone configuration 203, and independently of receiving the zoom direction 137, the zoom depth 139, the position information 207, or a combination thereof. For example, the pair selector 202 and the spatial filters 204 generate audio signals 205 corresponding to the microphone configuration 203 and to various values of the zoom direction 137, the zoom depth 139, the position information 207, or a combination thereof, and the signal selector 206 selects one of the audio signals 205 as the audio signal 145.

In a particular implementation, the signal selector and spatial filter 144 applies the spatial filtering based on the position information 207, and independently of receiving the zoom direction 137, the zoom depth 139, the microphone configuration 203, or a combination thereof. For example, the pair selector 202 and the spatial filters 204 generate audio signals 205 corresponding to the position information 207 and to various values of the zoom direction 137, the zoom depth 139, the microphone configuration 203, or a combination thereof, and the signal selector 206 selects one of the audio signals 205 as the audio signal 145.

In a particular implementation, the signal selector and spatial filter 144 applies the spatial filtering independently of receiving the microphone configuration 203 because the pair selector 202 and the spatial filters 204 are configured to generate the audio signals 205 for a single microphone configuration (e.g., a default headset microphone configuration 203).

In the pair selection example 250, the audio signal 211A corresponds to the microphone 120A and the audio signal 211B corresponds to the microphone 122A. The spatial filter 204A determines, based on the zoom direction 137, the zoom depth 139, the microphone configuration 203, or a combination thereof, that the zoom target 192 is closer to the microphone 122A than to the microphone 120A. In a particular implementation, the spatial filter 204A, in response to determining that the zoom target 192 is closer to the microphone 122A than to the microphone 120A, applies a second gain to the audio signal 211B (corresponding to the microphone 122A) that is higher than a first gain applied to the audio signal 211A (corresponding to the microphone 120A) to generate the audio signal 205A (e.g., an audio zoomed signal).

Similarly, in the pair selection example 250, the audio signal 213A corresponds to the microphone 122A and the audio signal 213B corresponds to the microphone 122N. The spatial filter 204B determines, based on the zoom direction 137, the zoom depth 139, the microphone configuration 203, or a combination thereof, that the zoom target 192 is closer to the microphone 122A than to the microphone 122N. In a particular implementation, the spatial filter 204B, in response to determining that the zoom target 192 is closer to the microphone 122A than to the microphone 120N, applies a third gain to the audio signal 213A (corresponding to the microphone 122A) that is higher than a fourth gain applied to the audio signal 213B (corresponding to the microphone 122N) to generate the audio signal 205B (e.g., an audio zoomed signal).

The signal selector 206 receives the audio signal 205A from the spatial filter 204A and the audio signal 205B from the spatial filter 204B. The signal selector 206 selects one of the audio signal 205A or the audio signal 205B to output as the audio signal 145. In a particular implementation, the signal selector 206 selects one of the audio signal 205A or the audio signal 205B corresponding to a lower energy to output as the audio signal 145. For example, the signal selector 206 determines a first energy of the audio signal 205A and a second energy of the audio signal 205B. The signal selector 206, in response to determining that the first energy is less than or equal to the second energy, outputs the audio signal 205A as the audio signal 145. Alternatively, the signal selector 206, in response to determining that the first energy is greater than the second energy, outputs the audio signal 205B as the audio signal 145. In a particular aspect, the selected one of the audio signal 205A or the audio signal 205B corresponding to the lower energy has less interference from audio sources (e.g., the audio source 184B) other than the zoom target 192. The audio signal 145 thus corresponds to an enhanced audio signal (e.g., an audio zoomed signal) that amplifies sound from audio sources closer to the zoom target 192, attenuates sound from audio sources further away from the zoom target 192, or both.

Figure 3:
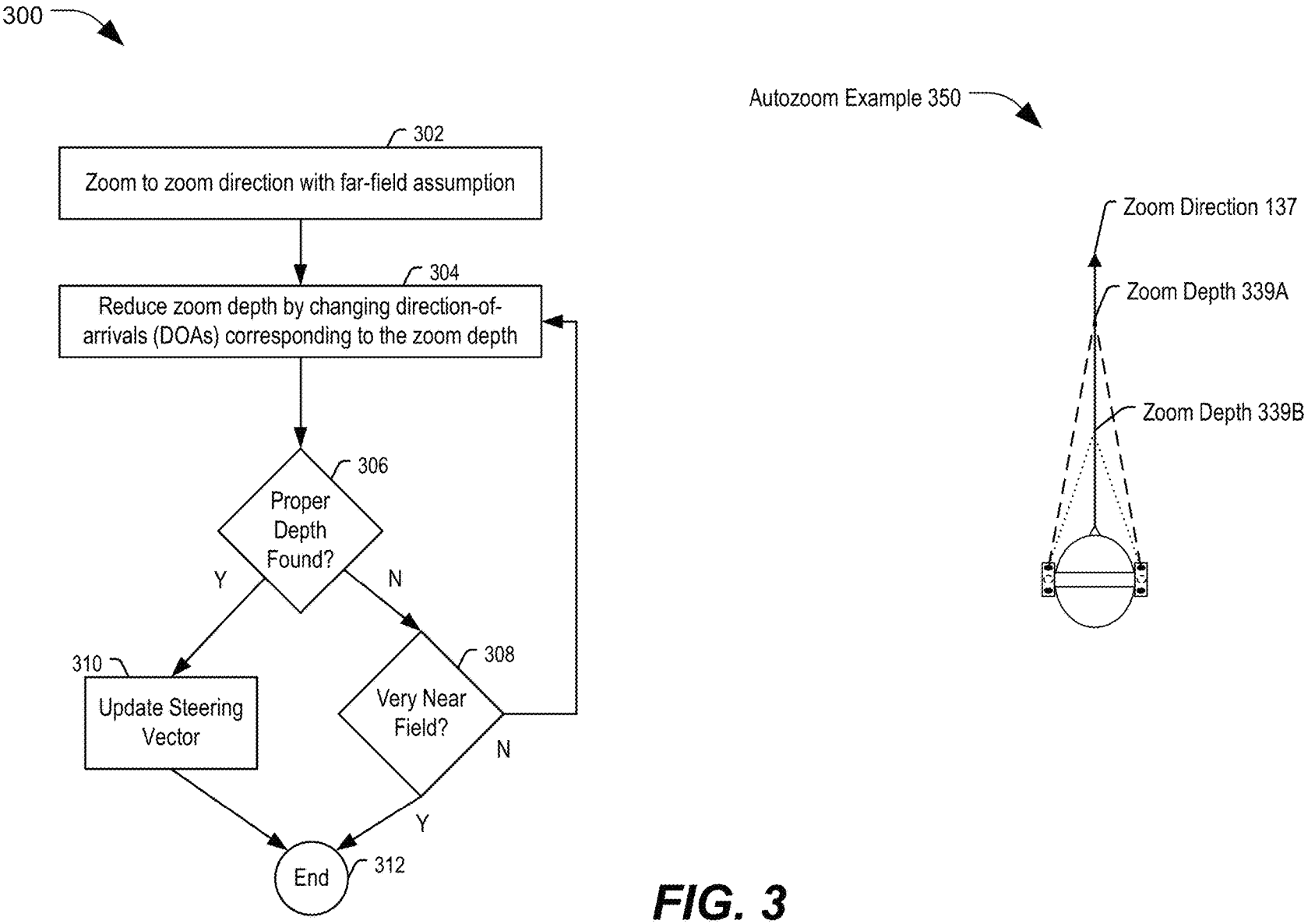
FIG. 3 is a diagram of a particular implementation of a method of pair selection that may be performed by a pair selector of the illustrative system of FIG. 1, in accordance with some examples of the present disclosure.

Referring to FIG. 3, a particular implementation of a method 300 of pair selection and an autozoom example 350 are shown. In a particular aspect, one or more operations of the method 300 are performed by at least one of the spatial filter 204A, the spatial filter 204B, the signal selector and spatial filter 144, the audio enhancer 140, the processor 190, the device 102, the system 100 of FIG. 1, or a combination thereof.

In the autozoom example 350, the signal selector and spatial filter 144 generates the audio signal 145 (e.g., performs the audio zoom) independently of receiving the zoom depth 139. To illustrate, the signal selector and spatial filter 144 performs the method 300 to iteratively select microphone pairs corresponding to various zoom depths, performs spatial filtering for the selected microphone pairs to generate audio enhanced signals, and selects one of the audio enhanced signals as the audio signal 145.

The method 300 includes zooming to the zoom direction 137 with far-field assumption, at 302. For example, the signal selector and spatial filter 144 selects a zoom depth 339A (e.g., an initial zoom depth, a default value, or both) corresponding to a far-field assumption.

The method 300 also includes reducing the zoom depth by changing direction of arrivals (DOAs) corresponding to the zoom depth. For example, the signal selector and spatial filter 144 of FIG. 2 reduces the zoom depth from the zoom depth 339A to a zoom depth 339B by changing DOAs from a first set of DOAs corresponding to the zoom depth 339A to a second set of DOAs corresponding to the zoom depth 339B. In a particular aspect, the pair selector 202 selects the microphone pair 220 and the microphone pair 222 based at least in part on the zoom depth 339B. Each of the spatial filter 204A and the spatial filter 204B performs spatial filtering (e.g., beamforming) based on the second set of DOAs corresponding to the zoom depth 339B. In an illustrative example, the spatial filter 204A determines that the audio signal 211A corresponds to a first microphone and that the audio signal 211B corresponds to a second microphone. The spatial filter 204A, in response to determining that first microphone is closer to the zoom target 192 than the second microphone is to the zoom target 192, performs spatial filtering to increase gains for the audio signal 211A, reduce gains for the audio signal 211B, or both, to generate the audio signal 205A. Similarly, the spatial filter 204B performs spatial filtering based on the second set of DOAs to generate the audio signal 205B.

The method 300 further includes determining whether the proper depth has been found, at 306. In an illustrative example, the signal selector and spatial filter 144 of FIG. 2 determines whether the zoom depth 339B is proper based on a comparison of the audio signal 205A and the audio signal 205B. For example, the signal selector and spatial filter 144 determines that the zoom depth 339B is proper in response to determining that a difference between the audio signal 205A and the audio signal 205B satisfies (e.g., is greater than) a zoom threshold. Alternatively, the signal selector and spatial filter 144 determines that the zoom depth 339B is not proper in response to determining that the difference between the audio signal 205A and the audio signal 205B fails to satisfy (e.g., is less than or equal to) the zoom threshold.

The method 300 includes, in response to determining that the proper depth has been found, at 306, updating a steering vector, at 310. For example, the signal selector and spatial filter 144 of FIG. 2, in response to determining that the zoom depth 339B is proper, selects the zoom depth 339B as the zoom depth 139 and provides the audio signal 205A and the audio signal 205B to the signal selector 206 of FIG. 2. The method 300 ends at 312. The signal selector and spatial filter 144, the audio enhancer 140, or both, may perform one or more additional operations subsequent to the end of the method 300.

The method 300 includes, in response to determining that the proper depth has not been found, at 306, determining whether the zoom depth 339B corresponds to very near field, at 308. For example, the signal selector and spatial filter 144, in response to determining that the zoom depth 339B is less than or equal to a depth threshold, determines that the zoom depth 339B corresponds to very near field and the method 300 ends at 312. Alternatively, the signal selector and spatial filter 144, in response to determining that the zoom depth 339B is greater than the depth threshold, determines the zoom depth 339B does not correspond to very near field, and the method 300 proceeds to 304 to select another zoom depth for analysis.

In some implementations, the audio enhancer 140 generates audio signals (e.g., enhanced audio signals) corresponding to various zoom depths and selects one of the audio signals as the audio signal 145 based on a comparison of energies of the audio signals. For example, the audio enhancer 140 generates a first version of the audio signal 145 corresponding to the zoom depth 339A as the zoom depth 139, as described with reference to FIG. 2. To illustrate, the audio enhancer 140 performs spatial filtering based on the first set of DOAs corresponding to the zoom depth 339A to generate the first version of the audio signal 145. The audio enhancer 140 generates a second version of the audio signal 145 corresponding to the zoom depth 339B as the zoom depth 139, as described with reference to FIG. 2. To illustrate, the audio enhancer 140 performs spatial filtering based on the second set of DOAs corresponding to the zoom depth 339B to generate the second version of the audio signal 145.

The audio enhancer 140, based on determining that a first energy of the first version of the audio signal 145 is less than or equal to a second energy of the second version of the audio signal 145, selects the first version of the audio signal 145 as the audio signal 145 and the zoom depth 339A as the zoom depth 139. Alternatively, the audio enhancer 140, based on determining that the first energy is greater than the second energy, selects the second version of the audio signal 145 as the audio signal 145 and the zoom depth 339B as the zoom depth 139. In a particular aspect, the various zoom depths are based on default data, a configuration setting, a user input, or a combination thereof.

The method 300 thus enables the signal selector and spatial filter 144 to perform autozoom independently of receiving the zoom depth 139. Alternatively, the zoom depth 139 is based on the sensor data 141 received from the depth sensor 132, and the method 300 enables fine-tuning the zoom depth 139. In the audio zoom example 350A, the zoom direction 137 is illustrated as corresponding to a particular value (e.g., "straight ahead" or "0 degrees") in the horizontal plane and a particular value (e.g., "straight ahead" or "0 degrees") in the vertical plane. In other examples, the zoom direction 137 can correspond to any value (e.g., greater than or equal to 0 and less than 360 degrees) in the horizontal plane and any value (e.g., greater than or equal to 0 and less than 360 degrees) in the vertical plane.

Figure 4:
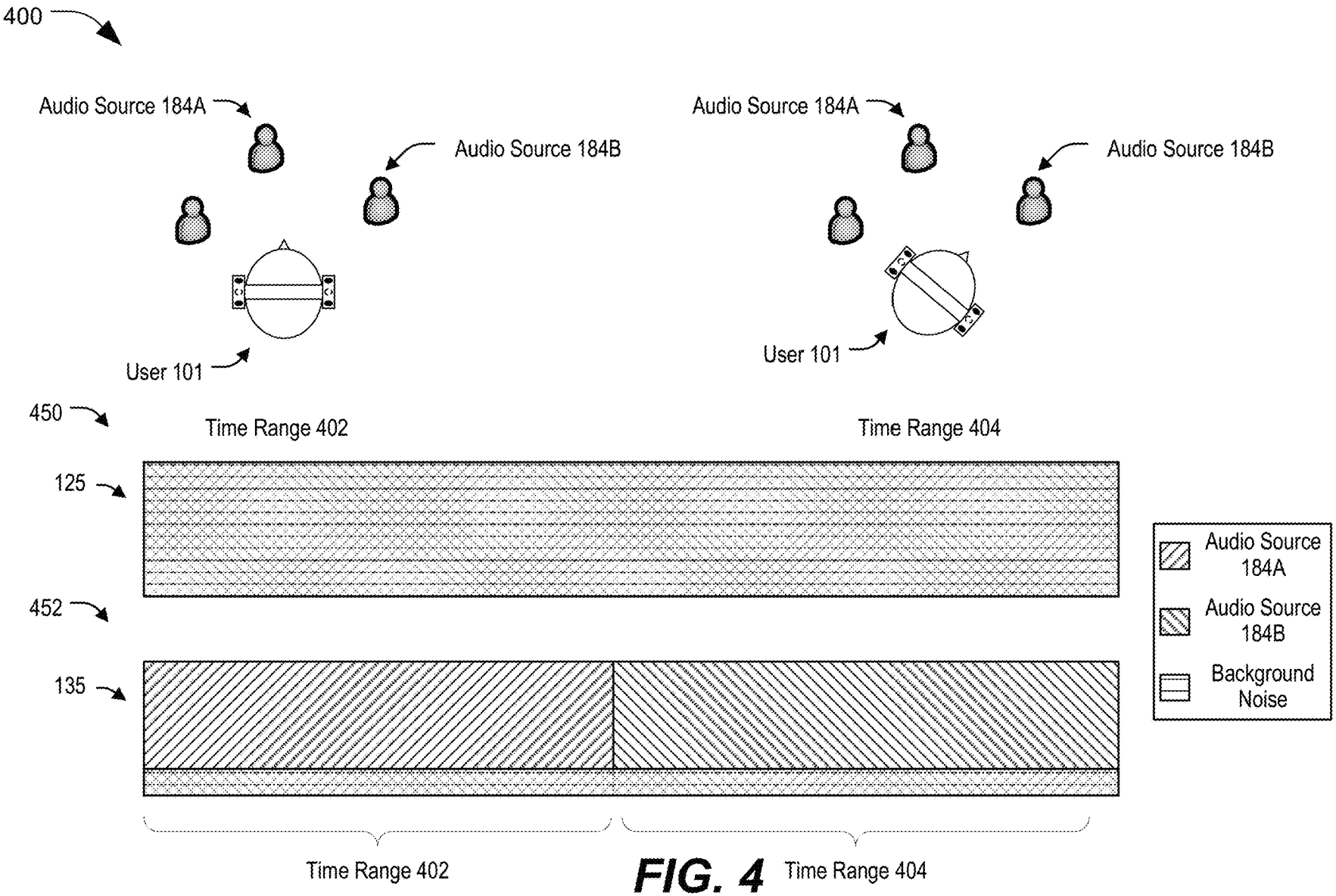
FIG. 4 is a diagram of an illustrative aspect of operation of the system of FIG. 1, in accordance with some examples of the present disclosure.

Referring to FIG. 4, a diagram 400 of an illustrative aspect of operation of the system 100 of FIG. 1 is shown. The user 101 is listening to audio from an audio source 184A, audio from an audio source 184B, and background noise. The user 101 activates the audio zoom of the headset 104.

In a particular implementation, the zoom target analyzer 130 determines the zoom direction 137, the zoom depth 139, or both, based on a user input 171, as described with reference to FIG. 1. In a particular example, the user input 171 includes a calendar event indicating that the user 101 is scheduled to have a meeting with a first person (e.g., "Bohdan Mustafa") and a second person (e.g., "Joanna Sikke") during a particular time period (e.g., "2-3 PM on Jun. 22, 2021"). If the user 101 is detected as looking at either the first person (e.g., the audio source 184A) or the second person (e.g., the audio source 184B) during the particular time period, the audio enhancer 140 designates that person as the zoom target 192. In a particular example, the user input 171 includes movement of the headset 104, and the zoom target analyzer 130 outputs a direction (e.g., in the horizontal plane, the vertical plane, or both) that the headset 104 is facing as the zoom direction 137. The signal selector and spatial filter 144 performs autozoom based on the zoom direction 137, as described with reference to FIG. 3, corresponding to a direction that the user 101 is facing. In a particular example, the user input 171 includes a tap on a touch sensor, a button, a dial, etc., and the zoom target analyzer 130 outputs the zoom depth 139 corresponding to the user input 171. To illustrate, one tap corresponds a first zoom depth and two taps correspond to a second zoom depth. While the audio zoom is activated, the user 101 looks towards the audio source 184A (e.g., "Bohdan Mustafa") during a time range 402 and towards the audio source 184B (e.g., "Joanna Sikke") during a time range 404. During the time range 402, the audio source 184A (e.g., "Bohdan Mustafa") corresponds to the zoom target 192 and the audio enhancer 140 generates the output signals 135 based on the zoom target 192. During the time range 404, the audio source 184B (e.g., "Joanna Sikke") corresponds to the zoom target 192 and the audio enhancer 140 generates the output signals 135 based on the zoom target 192.

A graph 450 illustrates an example of relative signal strength, energy, or perceptual prevalence of various audio sources (e.g., the audio source 184A, the audio source 184B, and one or more additional audio sources) in the input signals 125. The horizontal axis represents time, and the vertical axis indicates a proportion of the signal energies attributable to each of multiple audio sources, with first diagonal hatching pattern corresponding to the audio source 184A, a second diagonal hatching pattern corresponding to the audio source 184B, and a horizontal hatching pattern corresponding to background noise from the one or more additional audio sources. A graph 452 illustrates an example of relative signal energies of various audio sources in the combined output signals 135.

As illustrated, each of the audio source 184A, the audio source 184B, and the background noise spans the vertical range of the graph 450, indicating that none of the audio source 184A, the audio source 184B, or the background noise are preferentially enhanced or attenuated as received by the one or more microphones 120 and the one or more microphones 122 and input to the audio enhancer 140. In contrast, the graph 452 illustrates that over the time range 402 the audio source 184A spans the entire vertical range, but the span of the audio source 184B and the background noise are reduced to a relatively small portion of the vertical range, and over the time range 404 the audio source 184B spans the entire vertical range, while the span of the audio source 184A and the background noise are reduced to a relatively small portion of the vertical range. An audio source thus becomes more perceptible to the user 101 when the user 101 looks in the direction of the audio source, when the user 101 selects the audio source for audio zoom, or both.

Figure 5:
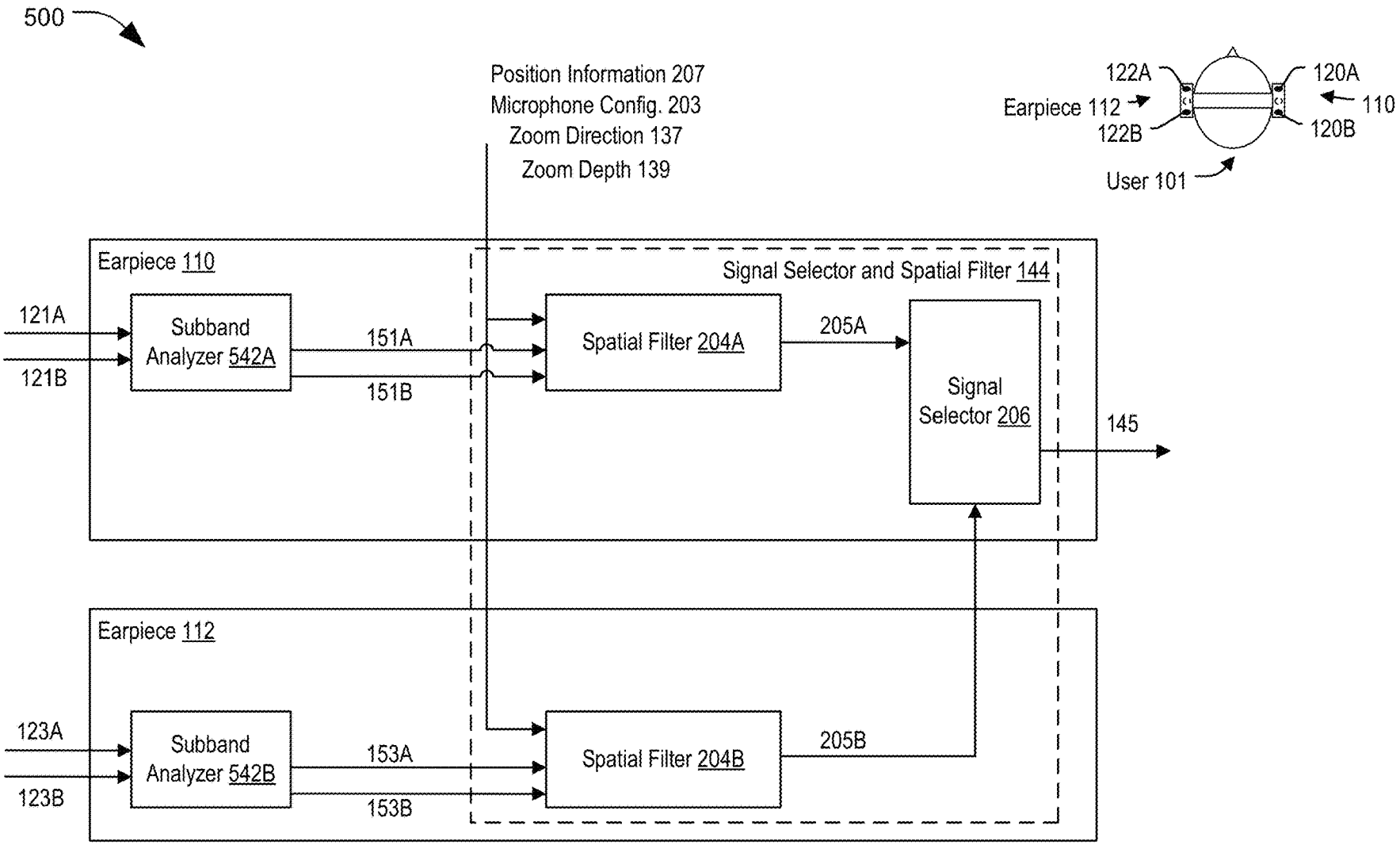
FIG. 5 is a diagram of an illustrative aspect of an implementation of components of the system of FIG. 1, in accordance with some examples of the present disclosure.

Referring to FIG. 5, a diagram 500 of an illustrative aspect of an implementation of components of the system 100 of FIG. 1 is shown in which at least a portion of the audio zoom processing performed by the device 102 in FIG. 1 is instead performed in the headset 104. As illustrated in the diagram 500, one or more components of the audio enhancer 140 are integrated in the headset 104. For example, the signal selector and spatial filter 144 is distributed across the earpiece 110 and the earpiece 112. To illustrate, the earpiece 110 includes the spatial filter 204A and the signal selector 206 of the signal selector and spatial filter 144, and the earpiece 112 includes the spatial filter 204B. In another implementation, the signal selector 206 is integrated in the earpiece 112 rather than the earpiece 110. The earpiece 110 includes a subband analyzer 542A coupled to the spatial filter 204A. The earpiece 112 includes a subband analyzer 542B coupled to the spatial filter 204B.

In a particular implementation, the headset 104 is configured to perform signal selection and spatial filtering of the audio signals from the microphones 120 and 122, and to provide the resulting audio signal 145 to the device 102. In an example, the device 102 of FIG. 1 includes the phase extractors 148, the magnitude extractors 158, the normalizers 164, the combiners 166, the magnitude extractor 146, and the subband synthesizer 170. In this example, the signal selector 206 is configured to provide the audio signal 145 from the earpiece 110 to the magnitude extractor 146 of the device 102. In other examples, additional functionality may be performed at the headset 104 instead of at the device 102, such as phase extraction, magnitude extraction, magnitude normalization, combining, subband synthesis, or any combination thereof.

In a particular example, two microphones are mounted on each of the earpieces. For example, a microphone 120A and a microphone 120B are mounted on the earpiece 110, and a microphone 122A and a microphone 122B are mounted on the earpiece 112. The subband analyzer 542A receives the input signals 121 from the microphones 120. For example, the subband analyzer 542A receives an input signal 121A from the microphone 120A and an input signal 121B from the microphone 120B. The subband analyzer 542A applies a transform (e.g., FFT) to the input signal 121A to generate an audio signal 151A and applies a transform (e.g., FFT) to the input signal 121B to generate an audio signal 151B.

Similarly, the subband analyzer 542B receives the input signals 123 from the microphones 122. For example, the subband analyzer 542B receives an input signal 123A from the microphone 122A and an input signal 123B from the microphone 122B. The subband analyzer 542B applies a transform (e.g., FFT) to the input signal 123A to generate an audio signal 153A and applies a transform (e.g., FFT) to the input signal 123B to generate an audio signal 153B.

The spatial filter 204A applies spatial filtering to the audio signal 151A and the audio signal 151B based on the zoom direction 137, the zoom depth 139, the microphone configuration 203, the position information 207, or a combination thereof, to generate the audio signal 205A, as described with reference to FIG. 2. Similarly, the spatial filter 204B applies spatial filtering to the audio signal 153A and the audio signal 153B based on the zoom direction 137, the zoom depth 139, the microphone configuration 203, the position information 207, or a combination thereof, to generate the audio signal 205B, as described with reference to FIG. 2.

The spatial filter 204B provides the audio signal 205B from the earpiece 112 via a communication link, such as a Bluetooth® (a registered trademark of Bluetooth Sig, Inc. of Kirkland, Wash.) communication link, to the signal selector 206 of the earpiece 110. In a particular aspect, the earpiece 112 compresses the audio signal 205B prior to transmission to the earpiece 110 to reduce the amount of data transferred. The signal selector 206 generates the audio signal 145 based on the audio signal 205A and the audio signal 205B, as described with reference to FIG. 2.

Performing the subband analysis, spatial filtering, and signal selection at the headset 104 enables reduced amount of wireless data transmission between the headset 104 and the device 102 (e.g., transmitting the audio signals 151A, 153A, and 145, as compared to transmitting all of the input signals 125, to the device 102). Distributing the subband analysis and spatial filtering between the earpieces 110 and 112 enables the headset 104 to perform the described functions using reduced processing resources, and hence lower component cost and power consumption for each earpiece, as compared to performing the described functions at a single earpiece.

Figure 6:
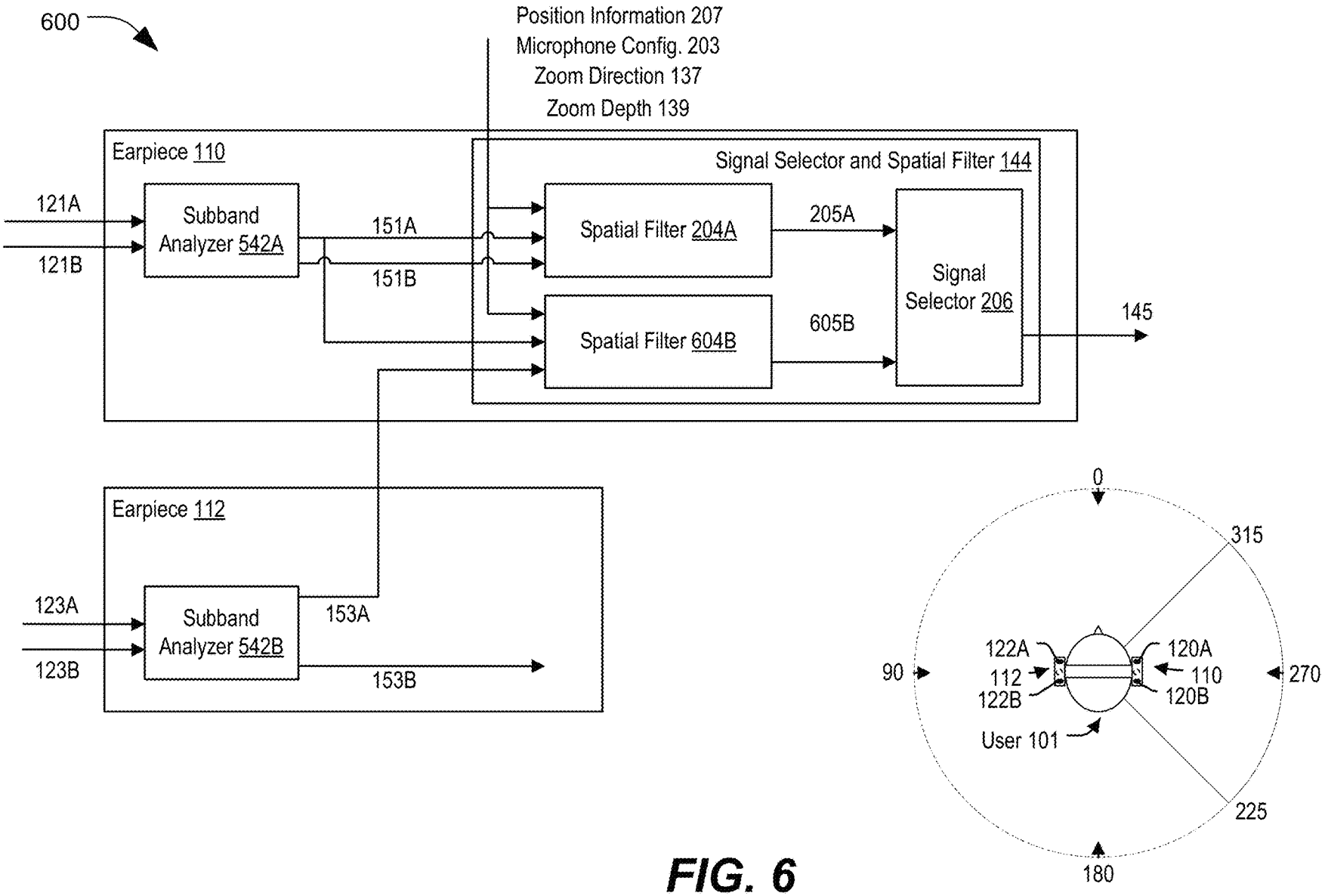
FIG. 6 is a diagram of an illustrative aspect of another implementation of components of the system of FIG. 1, in accordance with some examples of the present disclosure.

Referring to FIG. 6, a diagram 600 of an illustrative aspect of another implementation of components of the system 100 of FIG. 1 in which one or more components of the audio enhancer 140 are integrated in the headset 104. For example, the signal selector and spatial filter 144 is integrated in the earpiece 110, as compared to the diagram 500 of FIG. 5 in which the signal selector and spatial filter 144 is distributed between the earpiece 110 and the earpiece 112.

The subband analyzer 542B of the earpiece 112 provides a single one (e.g., the audio signal 153A) of the audio signals 153 to the signal selector and spatial filter 144. The signal selector and spatial filter 144 includes the spatial filter 204A and a spatial filter 604B. The spatial filter 604B performs spatial filtering on the audio signal 151A corresponding to the microphone 120A and the audio signal 153A corresponding to the microphone 122A to generate an audio signal 605B (e.g., an enhanced audio signal, such as an audio zoomed signal). The spatial filter 604B performs the spatial filtering based on the zoom direction 137, the zoom depth 139, the microphone configuration 203, the position information 207, or a combination thereof. In a particular aspect, the spatial filter 604B performs the spatial filtering with head shade effect correction. In a particular aspect, the operations described with reference to the diagram 600 support first values of the zoom direction 137 (e.g., from 225 degrees to 315 degrees or to the right of the user 101).

The signal selector 206 selects one of the audio signal 205A and the audio signal 605B to output as the audio signal 145, as described with reference to FIG. 2. In a particular aspect, the signal selector 206 outputs the audio signal 145 based on a comparison of a first frequency range (e.g., less than 1.5 kilohertz) of the audio signal 205A and the first frequency range of the audio signal 605B. For example, the signal selector 206 selects one of the audio signal 205A or the audio signal 605B with the first frequency range corresponding to lower energy. In a particular implementation, the signal selector 206 outputs the selected one of the audio signal 205A or the audio signal 605B as the audio signal 145. In an alternative implementation, the signal selector 206 extracts a first frequency portion of the selected one of the audio signal 205A or the audio signal 605B that corresponds to the first frequency range. The signal selector 206 extracts a second frequency portion of one of the audio signal 205A or the audio signal 605B that corresponds to a second frequency range (e.g., greater than or equal to 1.5 kilohertz). The signal selector 206 generates the audio signal 145 by combining the first frequency portion and the second frequency portion. The audio signal 145 may thus include the second frequency portion that is from the same audio signal or a different audio signal as the first frequency portion. The signal selector and spatial filter 144 integrated in the earpiece 110 is provided as an illustrative example. In another example, the signal selector and spatial filter 144 is integrated in the earpiece 112.

Figure 7:
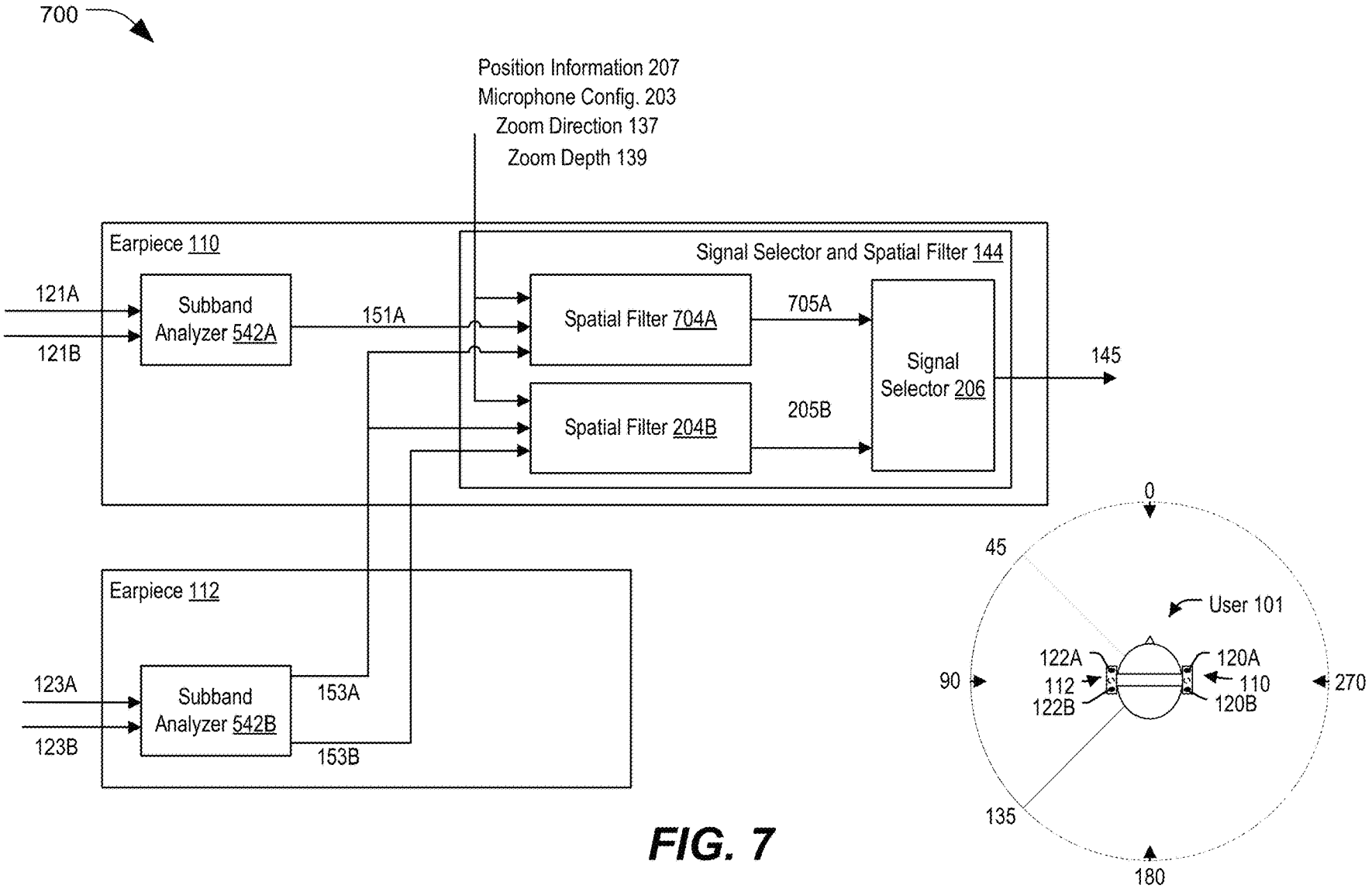
FIG. 7 is a diagram of an illustrative aspect of another implementation of components of the system of FIG. 1, in accordance with some examples of the present disclosure.

Referring to FIG. 7, a diagram 700 of an illustrative aspect of an implementation of components of the system 100 of FIG. 1 is shown. One or more components of the audio enhancer 140 are integrated in the headset 104. For example, the signal selector and spatial filter 144 is integrated in the earpiece 110.

The subband analyzer 542A provides a single one (e.g., the audio signal 151A) of the audio signals 151 to the signal selector and spatial filter 144. The subband analyzer 542B provides the audio signal 153A and the audio signal 153B to the signal selector and spatial filter 144. The signal selector and spatial filter 144 includes a spatial filter 704A and the spatial filter 204B. The spatial filter 704A performs spatial filtering on the audio signal 151A corresponding to the microphone 120A and the audio signal 153A corresponding to the microphone 122A to generate an audio signal 705B (e.g., an enhanced audio signal, such as an audio zoomed signal). The spatial filter 704A performs the spatial filtering based on the zoom direction 137, the zoom depth 139, the microphone configuration 203, the position information 207, or a combination thereof. In a particular aspect, the spatial filter 704A performs the spatial filtering with head shade effect correction. The spatial filter 204B performs spatial filtering on the audio signal 153A and the audio signal 153B to generate the audio signal 205B, as described with reference to FIG. 2. In a particular aspect, the operations described with reference to the diagram 700 support second values of the zoom direction 137 (e.g., from 45 degrees to 135 degrees or to the left of the user 101). In a particular aspect, the earpiece 110 and the earpiece 112 operate as described with reference to the diagram 600 of FIG. 6 for the first values of the zoom direction 137 (e.g., from 225 degrees to 315 degrees), as described with reference to the diagram 700 for the second values of the zoom direction 137 (e.g., from 45 degrees to 135 degrees), as described with reference to the diagram 500 of FIG. 5 for third values of the zoom direction 137 (e.g., from 0-45, 135-225, and 315-359 degrees).

The signal selector 206 selects one of the audio signal 705A and the audio signal 205B to output as the audio signal 145, as described with reference to FIG. 2. The signal selector and spatial filter 144 integrated in the earpiece 110 is provided as an illustrative example. In another example, the signal selector and spatial filter 144 is integrated in the earpiece 112. In a particular aspect, the signal selector 206 outputs the audio signal 145 based on a comparison of a first frequency range (e.g., less than 1.5 kilohertz) of the audio signal 705A and the first frequency range of the audio signal 205B. For example, the signal selector 206 selects one of the audio signal 705A or the audio signal 205B with the first frequency range corresponding to lower energy. In a particular implementation, the signal selector 206 outputs the selected one of the audio signal 705A or the audio signal 205B as the audio signal 145. In an alternative implementation, the signal selector 206 extracts a first frequency portion of the selected one of the audio signal 705A or the audio signal 205B that corresponds to the first frequency range. The signal selector 206 extracts a second frequency portion of one of the audio signal 705A or the audio signal 205B that corresponds to a second frequency range (e.g., greater than or equal to 1.5 kilohertz). The signal selector 206 generates the audio signal 145 by combining the first frequency portion and the second frequency portion. The audio signal 145 may thus include the second frequency portion that is from the same audio signal or a different audio signal as the first frequency portion.

Figure 8:
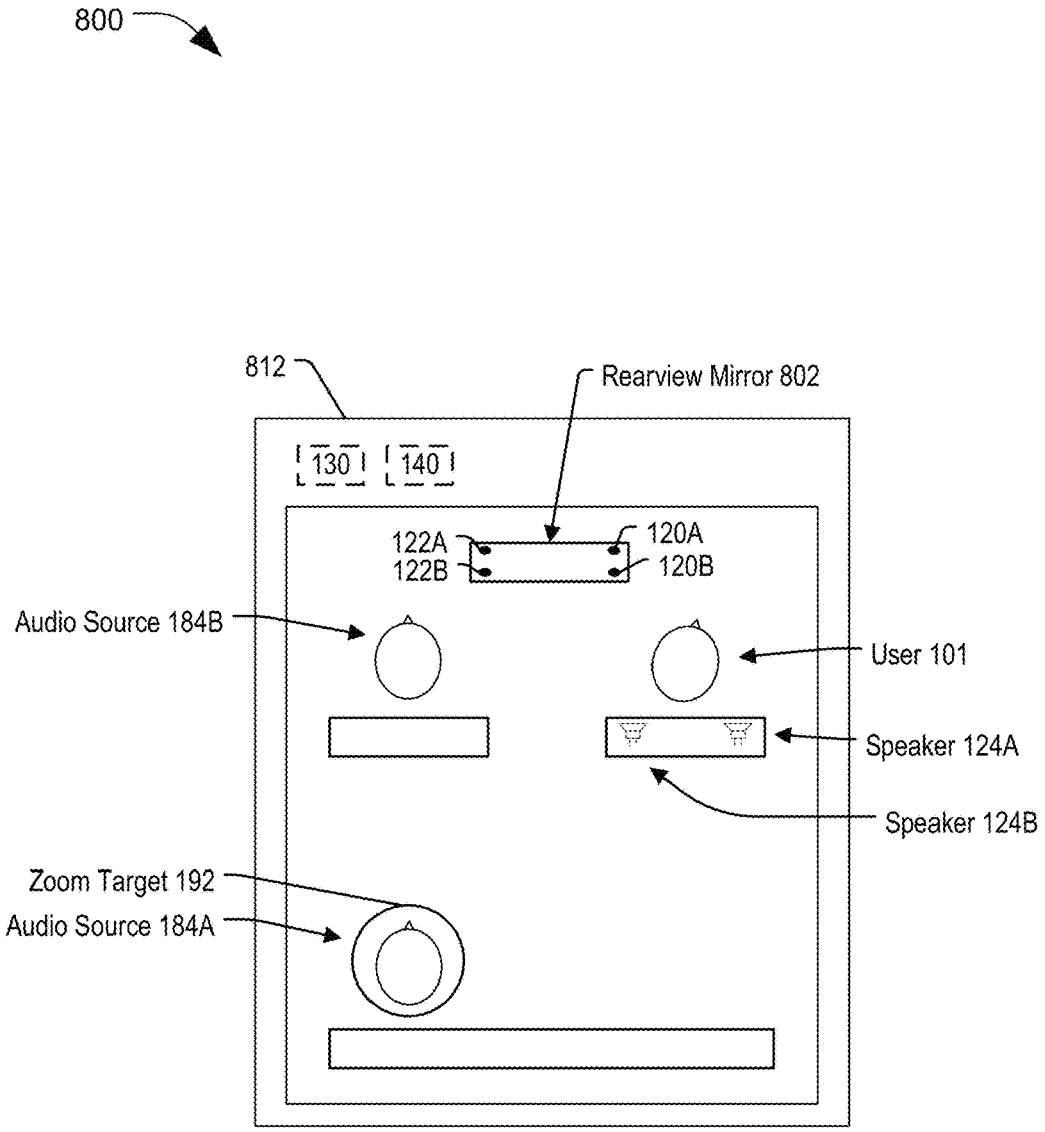
FIG. 8 is a diagram of an example of a vehicle operable to perform audio zoom, in accordance with some examples of the present disclosure.

FIG. 8 depicts an implementation 800 in which the device 102 corresponds to, or is integrated within, a vehicle 812, illustrated as a car. The vehicle 812 includes the processor 190 including the zoom target analyzer 130, the audio enhancer 140, or both. The vehicle 812 also includes the one or more microphones 120, the one or more microphones 122, or a combination thereof. The one or more microphones 120 and the one or more microphones 122 are positioned to capture utterances of an operator, one or more passengers, or a combination thereof, of the vehicle 812.

User voice activity detection can be performed based on audio signals received from the one or more microphones 120 and the one or more microphones 122 of the vehicle 812. In some implementations, user voice activity detection can be performed based on an audio signal received from interior microphones (e.g., the one or more microphones 120 and the one or more microphones 122), such as for a voice command from an authorized passenger. For example, the user voice activity detection can be used to detect a voice command from an operator of the vehicle 812 (e.g., from a parent to set a volume to 5 or to set a destination for a self-driving vehicle) and to disregard the voice of another passenger (e.g., a voice command from a child to set the volume to 10 or other passengers discussing another location). In some implementations, user voice activity detection can be performed based on an audio signal received from external microphones (e.g., the one or more microphones 120 and the one or more microphones 122), such as an authorized user of the vehicle. In a particular implementation, in response to receiving a verbal command identified as user speech via operation of the zoom target analyzer 130 and the audio enhancer 140, a voice activation system initiates one or more operations of the vehicle 812 based on one or more keywords (e.g., "unlock," "start engine," "play music," "display weather forecast," or another voice command) detected in the output signal 135, such as by providing feedback or information via a display or one or more speakers (e.g., the speaker 124A, the speaker 124B, or both).

In a particular aspect, the one or more microphones 120 and the one or more microphones 122 are mounted on a movable mounting structure (e.g., a rear view mirror 802) of the vehicle 812. In a particular aspect, the speaker 124A and the speaker 124B are integrated in or mounted on a seat (e.g., a headrest) of the vehicle 812.

In a particular aspect, the zoom target analyzer 130 receives the user input 171 (e.g., "zoom to rear left passenger" or "zoom to Sarah") indicating the zoom target 192 (e.g., a first occupant of the vehicle 812) from the user 101 (e.g., a second occupant of the vehicle 812). For example, the user input 171 indicates an audio source 184A (e.g., "Sarah"), a first location (e.g., "rear left") of the audio source 184A (e.g., the first occupant), the zoom direction 137, the zoom depth 139, or a combination thereof. In a particular aspect, the zoom target analyzer 130 determines the zoom direction 137, the zoom depth 139, or both, based on the first location of the audio source 184A (e.g., the first occupant), a second location (e.g., driver seat) of the user 101 (e.g., the second occupant), or both.

In a particular aspect, the zoom direction 137, the zoom depth 139, or both, are based on the first location of the first occupant (e.g., the audio source 184A). For example, the zoom direction 137 is based on a direction of the zoom target 192 (e.g., the audio source 184A) relative to the rearview mirror 802. In a particular aspect, the zoom depth 139 is based on a distance of the zoom target 192 (e.g., the audio source 184A) from the rearview mirror 802. In a particular aspect, the zoom target analyzer 130 adjusts the zoom direction 137, the zoom depth 139, or both, based on a difference in the location of the rearview mirror 802 and the location of the user 101 (e.g., the location of the speakers 124). In a particular aspect, the zoom target analyzer 130 adjusts the zoom direction 137, the zoom depth 139, or both, based on a head orientation of the user 101.

In a particular implementation, the audio enhancer 140 positions the rearview mirror 802 based on a location of the zoom target 192, a location of the audio source 184A (e.g., the first occupant), the zoom direction 137, the zoom depth 139, or a combination thereof. The audio enhancer 140 receives the input signals 121 and the input signals 123 from the one or more microphones 120 and the one or more microphones 122, respectively, mounted on the rearview mirror 802.

The audio enhancer 140 applies spatial filtering to the audio signals 151 (corresponding to the input signals 121) and the audio signals 153 (corresponding to the input signals 123) to generate the audio signal 205A and the audio signal 205B, as described with reference to FIG. 2. In a particular aspect, the audio enhancer 140 applies the spatial filtering based on the first location (e.g., "rear left passenger seat") of the first occupant (e.g., the audio source 184A) of the vehicle 812, the zoom direction 137, the zoom depth 139, the microphone configuration 203 of the one or more microphones 120 and the one or more microphones 122, a head orientation of the user 101 (e.g., the second occupant), the second location of the user 101, or a combination thereof.

In a particular implementation, the signal selector and spatial filter 144 of the audio enhancer 140 applies the spatial filtering based on one of the first location of the first occupant (e.g., the audio source 184A) of the vehicle 812, the zoom direction 137, the zoom depth 139, the microphone configuration 203, the head orientation of the user 101, or the second location of the user 101, and independently of receiving the remaining of the first location, the zoom direction 137, the zoom depth 139, the microphone configuration 203, the head orientation of the user 101, and the second location. For example, the signal selector and spatial filter 144 generates the audio signals 205 corresponding to one of the first location of the first occupant (e.g., the audio source 184A) of the vehicle 812, the zoom direction 137, the zoom depth 139, the microphone configuration 203, the head orientation of the user 101, or the second location of the user 101, and various values of the remaining of the first location, the zoom direction 137, the zoom depth 139, the microphone configuration 203, the head orientation of the user 101, and the second location. The signal selector 206 selects one of the audio signals 205 as the audio signal 145.

In a particular implementation, the signal selector and spatial filter 144 of the audio enhancer 140 applies the spatial filtering independently of receiving one or more of the first location of the first occupant (e.g., the audio source 184A) of the vehicle 812, the zoom direction 137, the zoom depth 139, the microphone configuration 203, the head orientation of the user 101, or the second location of the user 101. In a particular example, the signal selector and spatial filter 144 determines the zoom direction 137 based on the first location and a default location of the rearview mirror 802. In a particular example, the signal selector and spatial filter 144 uses various values of the zoom depth 139, as described with reference to FIG. 3. In a particular example, the signal selector and spatial filter 144 determines the zoom depth 139 based on the first location and a default location of the rearview mirror 802. In a particular example, the signal selector and spatial filter 144 uses various values of the zoom direction 137 to generate the audio signals 205 and the signal selector 206 selects one of the audio signals 205 as the audio signal 145.

In a particular example, the signal selector and spatial filter 144 is configured to generate the audio signals 205 corresponding to a single default second location (e.g., the driver seat) of the user 101. In a particular example, the signal selector and spatial filter 144 is configured to generate the audio signals 205 corresponding to a single default head orientation (e.g., facing forward) of the user 101. In a particular example, the signal selector and spatial filter 144 is configured to generate the audio signals 205 corresponding to a single default microphone configuration of the vehicle 812.

In a particular implementation, the signal selector and spatial filter 144 is configured to generate the audio signals 205 corresponding to a single location of the zoom target 192 of the vehicle 812. For example, the vehicle 812 includes a copy of the audio enhancer 140 for each of the seats of the vehicle 812. To illustrate, the vehicle 812 includes a first audio enhancer 140, a second audio enhancer 140, and a third audio enhancer 140 that is configured to perform an audio zoom to the back left seat, the back center seat, and the back right seat, respectively. The user 101 (e.g., an operator of the vehicle 812) can use a first input (e.g., a first button on the steering wheel), a second input (e.g., a second button), or a third input (e.g., a third button) to activate the first audio enhancer 140, the second audio enhancer 140, or the third audio enhancer 140, respectively.

The audio enhancer 140 selects one of the audio signal 205A and the audio signal 205B as the audio signal 145, as described with reference to FIG. 2, and generates the output signals 135 based on the audio signal 145, as described with reference to FIG. 1. The audio enhancer 140 provides the output signal 131 and the output signal 133 to the speaker 124A and the speaker 124B, respectively, to play out the audio zoomed signal to the user 101 (e.g., the second occupant) of the vehicle 812. In a particular aspect, the output signals 135 correspond to higher gain applied to sounds received from the audio source 184A, lower gains applied to sounds received from an audio source 184B, or both. In a particular aspect, the output signals 135 have the same phase difference and the same relative magnitude difference as a representative one of the input signals 121 and a representative one of the input signals 123 received by the rearview mirror 802.

Figure 9:
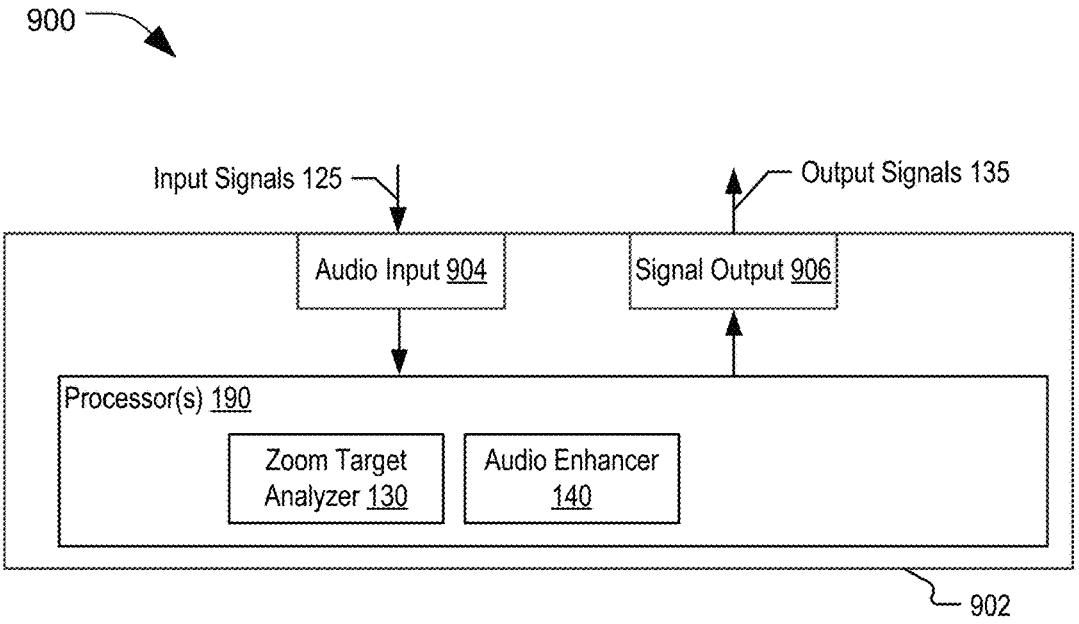
FIG. 9 illustrates an example of an integrated circuit operable to perform audio zoom, in accordance with some examples of the present disclosure.

FIG. 9 depicts an implementation 900 of the device 102 as an integrated circuit 902 that includes the one or more processors 190. The integrated circuit 902 also includes an audio input 904, such as one or more bus interfaces, to enable the input signals 125 to be received for processing. The integrated circuit 902 also includes a signal output 906, such as a bus interface, to enable sending of an output signal, such as the output signals 135. The integrated circuit 902 enables implementation of audio zoom as a component in a system that includes microphones, such as a headset as depicted in FIG. 10, a virtual reality headset or an augmented reality headset as depicted in FIG. 11, or a vehicle as depicted in FIG. 8.

Figure 10:
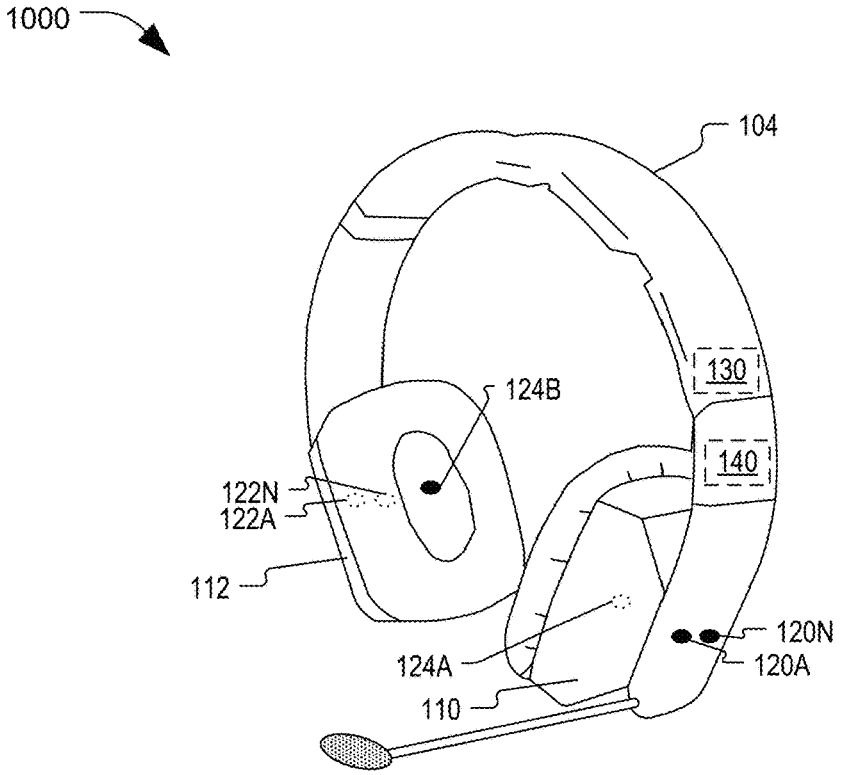
FIG. 10 is a diagram of a first example of a headset operable to perform audio zoom, in accordance with some examples of the present disclosure.

FIG. 10 depicts an implementation 1000 in which the device 102 includes the headset 104. For example, one or more of the components of the device 102 are integrated in the headset 104. The headset 104 includes the earpiece 110 and the earpiece 112. In a particular aspect, the one or more microphones 120 and the one or more microphones 122 are mounted externally on the earpiece 110 and the earpiece 112, respectively. In a particular aspect, the speaker 124A and the speaker 124B are mounted internally on the earpiece 110 and the earpiece 112, respectively. Components of the processor 190, including the zoom target analyzer 130, the audio enhancer 140, or both, are integrated in the headset 104. In a particular example, the audio enhancer 140 operates to detect user voice activity, which may cause the headset 104 to perform one or more operations at the headset 104, to transmit audio data corresponding to the user voice activity to a second device (not shown) for further processing, or a combination thereof. In a particular aspect, the audio enhancer 140 operates to audio zoom to an external sound while maintaining the binaural sensation for the wearer of the headset 104.

Figure 11:
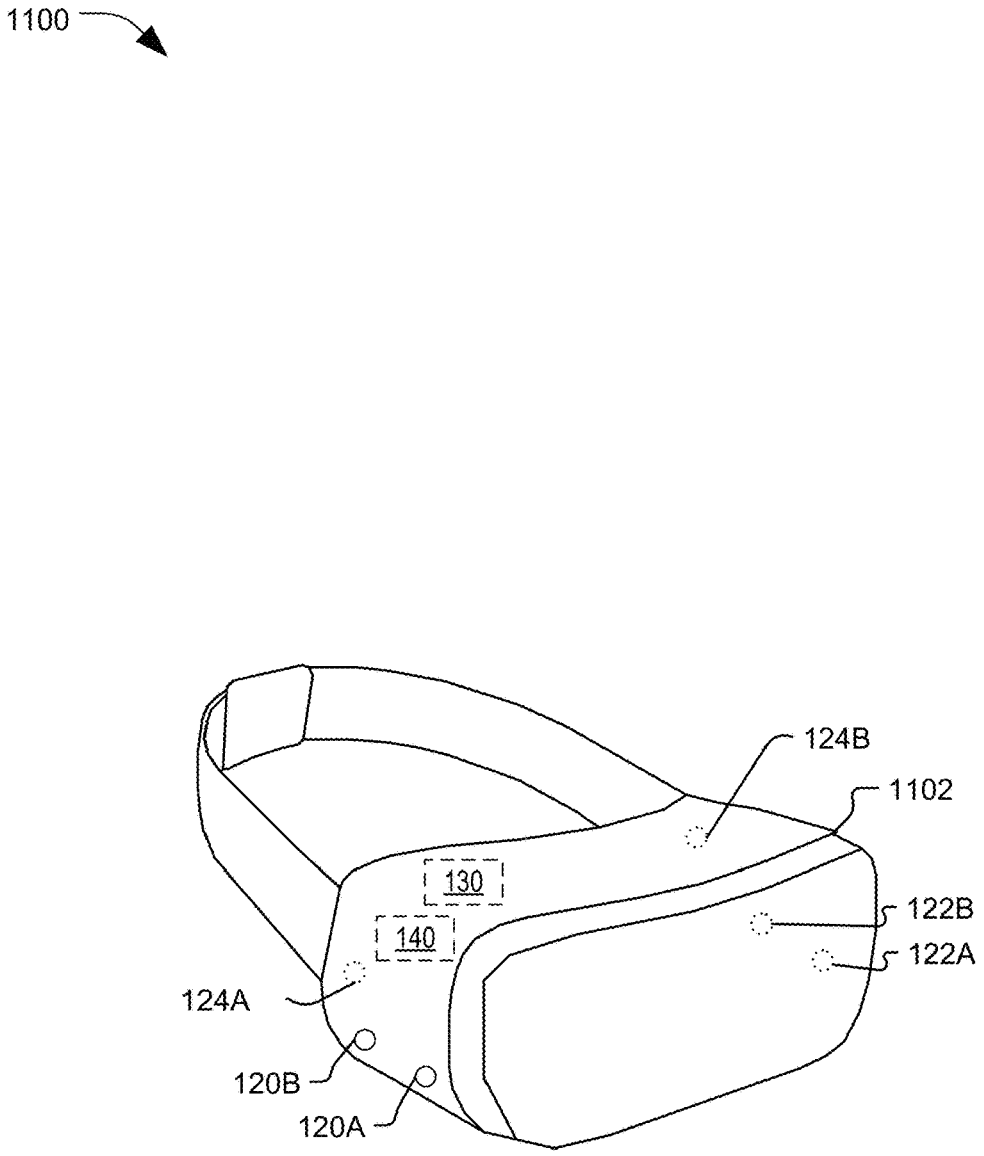
FIG. 11 is a diagram of a second example of a headset, such as a virtual reality or augmented reality headset, operable to perform audio zoom, in accordance with some examples of the present disclosure.

FIG. 11 depicts an implementation 1100 in which the device 102 includes a portable electronic device that corresponds to a virtual reality, augmented reality, or mixed reality headset 1102. The zoom target analyzer 130, the audio enhancer 140, the one or more microphones 120, the one or more microphones 122, the speaker 124A, the speaker 124B, or a combination thereof, are integrated into the headset 1102. In a particular aspect, the headset 1102 includes the one or more microphones 120 and the one or more microphones 122 to primarily capture environmental sounds. User voice activity detection can be performed based on audio signals received from the one or more microphones 120 and the one or more microphones 122 of the headset 1102. A visual interface device is positioned in front of the user's eyes to enable display of augmented reality or virtual reality images or scenes to the user while the headset 1102 is worn. In a particular example, the visual interface device is configured to display a notification indicating user speech detected in the audio signal.

Figure 12:
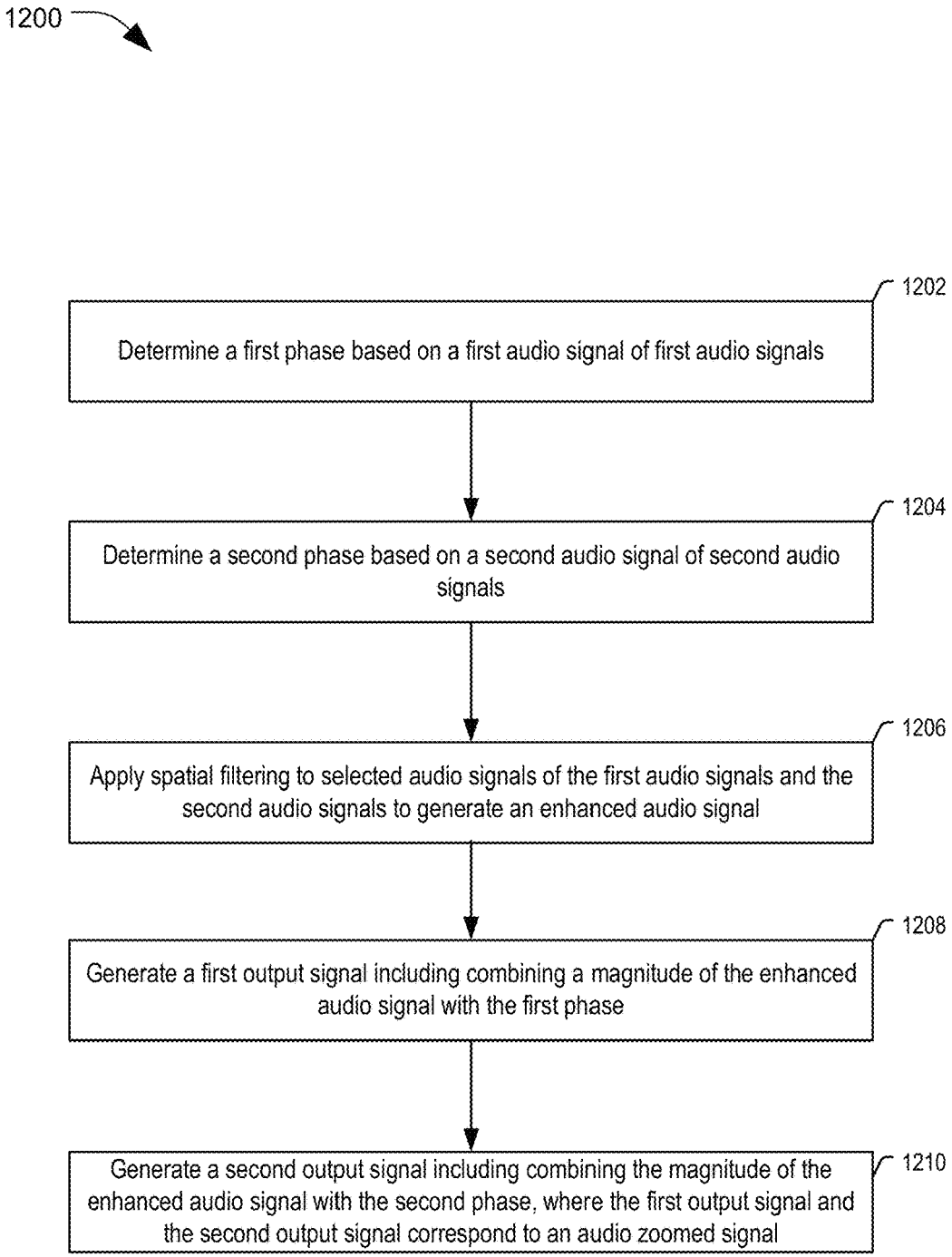
FIG. 12 is diagram of a particular implementation of a method of performing audio zoom that may be performed by the system of FIG. 1, in accordance with some examples of the present disclosure.

Referring to FIG. 12, a particular implementation of a method 1200 of audio zoom is shown. In a particular aspect, one or more operations of the method 1200 are performed by at least one of the phase extractor 148A, the phase extractor 148B, the signal selector and spatial filter 144, the combiner 166A, the combiner 166B, the spatial filter 204A, the spatial filter 204B, the audio enhancer 140, the processor 190, the device 102, the system 100 of FIG. 1, or a combination thereof.

The method 1200 includes determining a first phase based on a first audio signal of first audio signals, at 1202. For example, the phase extractor 148A of FIG. 1 determines the phase 161A based on the input signal 121A of the input signals 121, as described with reference to FIG. 1.

The method 1200 also includes determining a second phase based on a second audio signal of second audio signals, at 1204. For example, the phase extractor 148B of FIG. 1 determines the phase 161B based on the input signal 123A of the input signals 123, as described with reference to FIG. 1.

The method 1200 further includes applying spatial filtering to selected audio signals of the first audio signals and the second audio signals to generate an enhanced audio signal, at 1206. For example, the pair selector 202 of FIG. 2 selects the audio signal 211A and the audio signal 211B and selects the audio signal 213A and the audio signal 213B from the audio signals 155, as described with reference to FIG. 2. The spatial filter 204A applies spatial filtering to the audio signal 211A and the audio signal 211B to generate the audio signal 205A (e.g., a first enhanced audio signal). The spatial filter 204B applies spatial filtering to the audio signal 213A and the audio signal 213B to generate the audio signal 205B (e.g., a second enhanced audio signal). The signal selector 206 outputs one of the audio signal 205A or the audio signal 205B as the audio signal 145 (e.g., an enhanced audio signal), as described with reference to FIG. 2.

The method 1200 also includes generating a first output signal including combining a magnitude of the enhanced audio signal with the first phase, at 1208. For example, the combiner 166A of FIG. 1 generates the audio signal 167A by combining the magnitude 147 of the audio signal 145 with the phase 161A based on the normalization factor 165A, as described with reference to FIG. 1. The subband synthesizer 170 generates the output signal 131 by applying a transform to the audio signal 167A, as described with reference to FIG. 1.

The method 1200 further includes generating a second output signal including combining the magnitude of the enhanced audio signal with the second phase, at 1210. For example, the combiner 166B of FIG. 1 generates the audio signal 167B by combining the magnitude 147 of the audio signal 145 with the phase 161B based on the normalization factor 165B, as described with reference to FIG. 1. The subband synthesizer 170 generates the output signal 133 by applying a transform to the audio signal 167B, as described with reference to FIG. 1. The output signal 131 and the output signal 133 correspond to an audio zoomed signal.

The method 1200 provides audio zoom while preserving the overall binaural sensation for the user 101 listening to the output signals 135. For example, the overall binaural sensation is preserved by maintaining the phase difference and the magnitude difference between the output signal 131 output by the speaker 124A and the output signal 133 output by the speaker 124B. The phase difference is maintained by generating the output signal 131 based on the phase 161A of the audio signal 151A (e.g., a representative right input signal) and generating the output signal 133 based on the phase 161B of the audio signal 153A (e.g., a representative left input signal). The magnitude difference is maintained by generating the output signal 131 based on the normalization factor 165A and the magnitude 147 and by generating the output signal 133 based on the normalization factor 165B and the magnitude 147.

The method 1200 of FIG. 12 may be implemented by a field-programmable gate array (FPGA) device, an application-specific integrated circuit (ASIC), a processing unit such as a central processing unit (CPU), a DSP, a controller, another hardware device, firmware device, or any combination thereof. As an example, the method 1200 of FIG. 12 may be performed by a processor that executes instructions, such as described with reference to FIG. 13.

Figure 13:
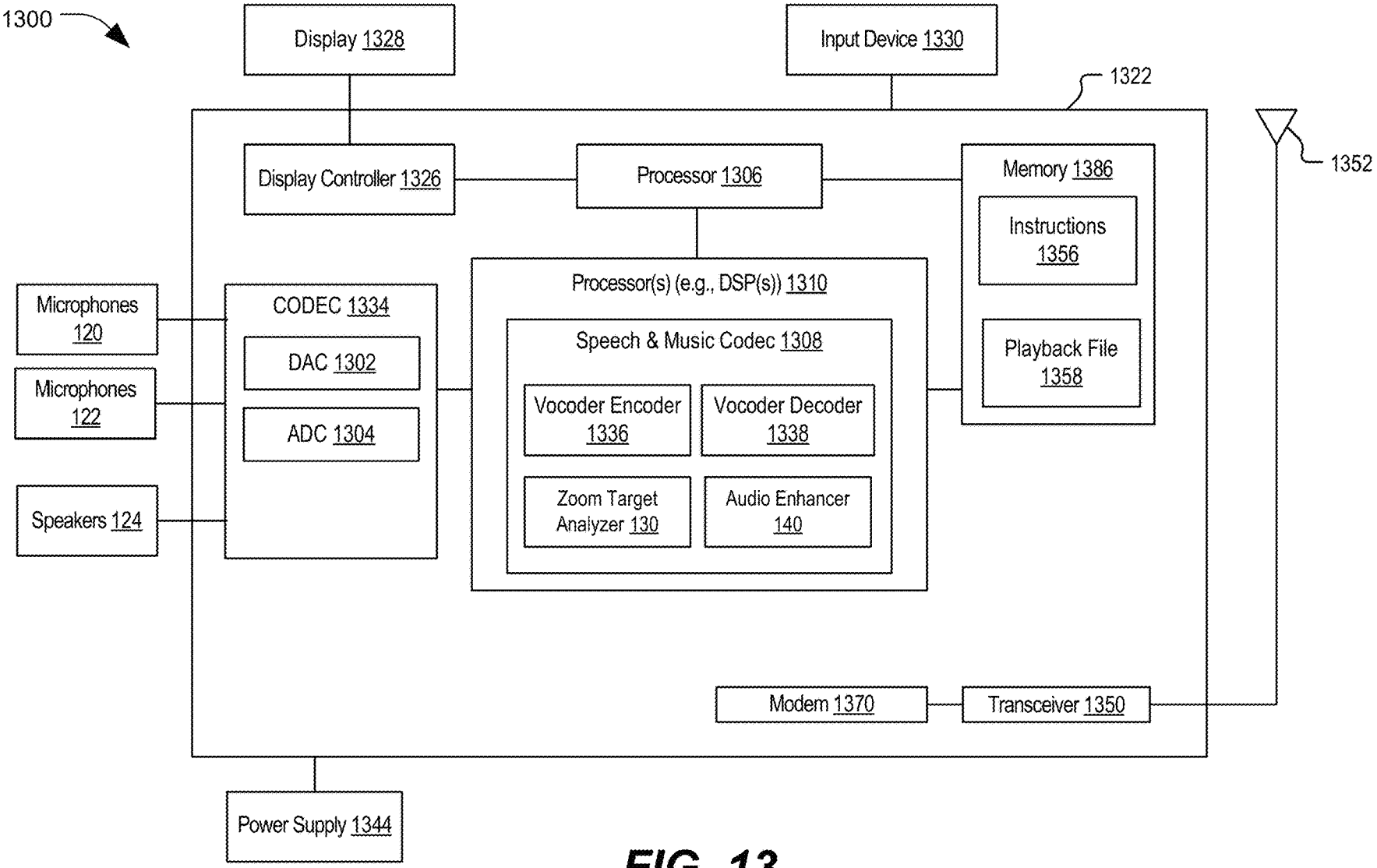
FIG. 13 is a block diagram of a particular illustrative example of a device that is operable to perform audio zoom, in accordance with some examples of the present disclosure.

Referring to FIG. 13, a block diagram of a particular illustrative implementation of a device is depicted and generally designated 1300. In various implementations, the device 1300 may have more or fewer components than illustrated in FIG. 13. In an illustrative implementation, the device 1300 may correspond to the device 102. In an illustrative implementation, the device 1300 may perform one or more operations described with reference to FIGS. 1-12.

In a particular implementation, the device 1300 includes a processor 1306 (e.g., a central processing unit (CPU)). The device 1300 may include one or more additional processors 1310 (e.g., one or more DSPs). In a particular aspect, the processor 190 of FIG. 1 corresponds to the processor 1306, the processors 1310, or a combination thereof. The processors 1310 may include a speech and music coder-decoder (CODEC) 1308 that includes a voice coder ("vocoder") encoder 1336, a vocoder decoder 1338, the zoom target analyzer 130, the audio enhancer 140, or a combination thereof.

The device 1300 may include a memory 1386 and a CODEC 1334. The memory 1386 may include instructions 1356, that are executable by the one or more additional processors 1310 (or the processor 1306) to implement the functionality described with reference to the zoom target analyzer 130, the audio enhancer 140, or both. In a particular aspect, the memory 1386 stores a playback file 1358 and the audio enhancer 140 decodes audio data of the playback file 1358 to generate the input signals 125, as described with reference to FIG. 1. The device 1300 may include a modem 1370 coupled, via a transceiver 1350, to an antenna 1352.

The device 1300 may include a display 1328 coupled to a display controller 1326. One or more speakers 124, the one or more microphones 120, the one or more microphones 122, or a combination thereof, may be coupled to the CODEC 1334. The CODEC 1334 may include a digital-to-analog converter (DAC) 1302, an analog-to-digital converter (ADC) 1304, or both. In a particular implementation, the CODEC 1334 may receive analog signals from the one or more microphones 120 and the one or more microphones 122, convert the analog signals to digital signals using the analog-to-digital converter 1304, and provide the digital signals to the speech and music codec 1308. The speech and music codec 1308 may process the digital signals, and the digital signals may further be processed by the audio enhancer 140. In a particular implementation, the speech and music codec 1308 may provide digital signals to the CODEC 1334. The CODEC 1334 may convert the digital signals to analog signals using the digital-to-analog converter 1302 and may provide the analog signals to the one or more speakers 124.

In a particular implementation, the device 1300 may be included in a system-in-package or system-on-chip device 1322. In a particular implementation, the memory 1386, the processor 1306, the processors 1310, the display controller 1326, the CODEC 1334, and the modem 1370 are included in a system-in-package or system-on-chip device 1322. In a particular implementation, an input device 1330 and a power supply 1344 are coupled to the system-on-chip device 1322. Moreover, in a particular implementation, as illustrated in FIG. 13, the display 1328, the input device 1330, the one or more speakers 124, the one or more microphones 120, the one or more microphones 122, the antenna 1352, and the power supply 1344 are external to the system-on-chip device 1322. In a particular implementation, each of the display 1328, the input device 1330, the one or more speakers 124, the one or more microphones 120, the one or more microphones 122, the antenna 1352, and the power supply 1344 may be coupled to a component of the system-on-chip device 1322, such as an interface or a controller.

The device 1300 may include a smart speaker, a speaker bar, a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, a navigation device, a vehicle, a headset, an augmented reality headset, a virtual reality headset, an aerial vehicle, a home automation system, a voice-activated device, a wireless speaker and voice activated device, a portable electronic device, a car, a vehicle, a computing device, a communication device, an internet-of-things (IoT) device, a virtual reality (VR) device, a base station, a mobile device, or any combination thereof.

In conjunction with the described implementations, an apparatus includes means for determining a first phase based on a first audio signal of first audio signals. For example, the means for determining the first phase can correspond to the phase extractor 148A of FIG. 1, the audio enhancer 140, the one or more processors 190, the device 102, the system 100 of FIG. 1, the processor 1306, the processors 1310, one or more other circuits or components configured to determine a first phase based on a first audio signal, or any combination thereof.

The apparatus also includes means for determining a second phase based on a second audio signal of second audio signals. For example, the means for determining the second phase can correspond to the phase extractor 148B of FIG. 1, the audio enhancer 140, the one or more processors 190, the device 102, the system 100 of FIG. 1, the processor 1306, the processors 1310, one or more other circuits or components configured to determine a second phase based on a second audio signal, or any combination thereof.

The apparatus further includes means for applying spatial filtering to selected audio signals of the first audio signals and the second audio signals to generate an enhanced audio signal. For example, the means for applying spatial filtering can correspond to the signal selector and spatial filter 144, the audio enhancer 140, the one or more processors 190, the device 102, the system 100 of FIG. 1, the spatial filter 204A of FIG. 2, the processor 1306, the processors 1310, one or more other circuits or components configured to apply spatial filtering, or any combination thereof.

The apparatus also includes means for generating a first output signal including combining a magnitude of the enhanced audio signal with the first phase. For example, the means for generating a first output signal can correspond to the combiner 166A, the subband synthesizer 170, the audio enhancer 140, the one or more processors 190, the device 102, the system 100 of FIG. 1, the processor 1306, the processors 1310, one or more other circuits or components configured to generate the first output signal, or any combination thereof.

The apparatus further includes means for generating a second output signal including combining the magnitude of the enhanced audio signal with the second phase. For example, the means for generating a second output signal can correspond to the combiner 166B, the subband synthesizer 170, the audio enhancer 140, the one or more processors 190, the device 102, the system 100 of FIG. 1, the processor 1306, the processors 1310, one or more other circuits or components configured to generate the second output signal, or any combination thereof. The first output signal and the second output signal correspond to an audio zoomed signal.

In some implementations, a non-transitory computer-readable medium (e.g., a computer-readable storage device, such as the memory 1386) includes instructions (e.g., the instructions 1356) that, when executed by one or more processors (e.g., the one or more processors 190, the one or more processors 1310, or the processor 1306), cause the one or more processors to determine a first phase (e.g., the phase 161A) based on a first audio signal (e.g., the input signal 121A) of first audio signals (e.g., the input signals 121) and to determine a second phase (e.g., the phase 161B) based on a second audio signal (e.g., the input signal 123A) of second audio signals (e.g., the input signals 123). The instructions, when executed by the one or more processors, also cause the one or more processors to apply spatial filtering to selected audio signals (e.g., the audio signal 211A, the audio signal 211B, the audio signal 213A, and the audio signal 213B) of the first audio signals and the second audio signals to generate an enhanced audio signal (e.g., the audio signal 145). The instructions, when executed by the one or more processors, further cause the one or more processors to generate a first output signal (e.g., the output signal 131) including combining a magnitude (e.g., the magnitude 147) of the enhanced audio signal with the first phase. The instructions, when executed by the one or more processors, also cause the one or more processors to generate a second output signal (e.g., the output signal 133) including combining the magnitude of the enhanced audio signal with the second phase. The first output signal and the second output signal correspond to an audio zoomed signal.

Particular aspects of the disclosure are described below in sets of interrelated clauses:

According to Clause 1, a device includes: a memory configured to store instructions; and one or more processors configured to execute the instructions to: determine a first phase based on a first audio signal of first audio signals; determine a second phase based on a second audio signal of second audio signals; apply spatial filtering to selected audio signals of the first audio signals and the second audio signals to generate an enhanced audio signal; generate a first output signal including combining a magnitude of the enhanced audio signal with the first phase; and generate a second output signal including combining the magnitude of the enhanced audio signal with the second phase, wherein the first output signal and the second output signal correspond to an audio zoomed signal.

Clause 2 includes the device of Clause 1, wherein the one or more processors are further configured to: receive the first audio signals from a first plurality of microphones mounted externally to a first earpiece of a headset; and receive the second audio signals from a second plurality of microphones mounted externally to a second earpiece of the headset.

Clause 3 includes the device of Clause 2, wherein the one or more processors are configured to apply the spatial filtering based on a zoom direction, a zoom depth, a configuration of the first plurality of microphones and the second plurality of microphones, or a combination thereof.

Clause 4 includes the device of Clause 3, wherein the one or more processors are configured to determine the zoom direction, the zoom depth, or both, based on a tap detected via a touch sensor of the headset.

Clause 5 includes the device of Clause 3 or Clause 4, wherein the one or more processors are configured to determine the zoom direction, the zoom depth, or both, based on a movement of the headset.

Clause 6 includes the device of Clause 2, wherein the one or more processors are configured to apply the spatial filtering based on a zoom direction.

Clause 7 includes the device of Clause 6, wherein the one or more processors are configured to determine the zoom direction based on a tap detected via a touch sensor of the headset.

Clause 8 includes the device of Clause 6 or Clause 7, wherein the one or more processors are configured to determine the zoom direction based on a movement of the headset.

Clause 9 includes the device of Clause 2, wherein the one or more processors are configured to apply the spatial filtering based on a zoom depth.

Clause 10 includes the device of Clause 9, wherein the one or more processors are configured to determine the zoom depth based on a tap detected via a touch sensor of the headset.

Clause 11 includes the device of Clause 9 or Clause 10, wherein the one or more processors are configured to determine the zoom depth based on a movement of the headset.

Clause 12 includes the device of Clause 2, wherein the one or more processors are configured to apply the spatial filtering based on a configuration of the first plurality of microphones and the second plurality of microphones.

Clause 13 includes the device of any of Clause 1 to Clause 12, wherein the one or more processors are integrated into a headset.

Clause 14 includes the device of any of Clause 1 to Clause 13, wherein the one or more processors are further configured to: provide the first output signal to a first speaker of a first earpiece of a headset; and provide the second output signal to a second speaker of a second earpiece of the headset.

Clause 15 includes the device of Clause 1 or Clause 14, wherein the one or more processors are further configured to decode audio data of a playback file to generate the first audio signals and the second audio signals.

Clause 16 includes the device of Clause 15, wherein the audio data includes position information indicating positions of sources of each of the first audio signals and the second audio signals, and wherein the one or more processors are configured to apply the spatial filtering based on a zoom direction, a zoom depth, the position information, or a combination thereof.

Clause 17 includes the device of Clause 15, wherein the audio data includes position information indicating positions of sources of each of the first audio signals and the second audio signals, and wherein the one or more processors are configured to apply the spatial filtering based on a zoom direction.

Clause 18 includes the device of Clause 15, wherein the audio data includes position information indicating positions of sources of each of the first audio signals and the second audio signals, and wherein the one or more processors are configured to apply the spatial filtering based on a zoom depth.

Clause 19 includes the device of Clause 15, wherein the audio data includes position information indicating positions of sources of each of the first audio signals and the second audio signals, and wherein the one or more processors are configured to apply the spatial filtering based on the position information.

Clause 20 includes the device of Clause 15, wherein the audio data includes a multi-channel audio representation of one or more audio sources, and wherein the one or more processors are configured to apply the spatial filtering based on a zoom direction, a zoom depth, the multi-channel audio representation, or a combination thereof.

Clause 21 includes the device of Clause 15, wherein the audio data includes a multi-channel audio representation of one or more audio sources, and wherein the one or more processors are configured to apply the spatial filtering based on a zoom direction.

Clause 22 includes the device of Clause 15, wherein the audio data includes a multi-channel audio representation of one or more audio sources, and wherein the one or more processors are configured to apply the spatial filtering based on a zoom depth.

Clause 23 includes the device of Clause 15, wherein the audio data includes a multi-channel audio representation of one or more audio sources, and wherein the one or more processors are configured to apply the spatial filtering based on the multi-channel audio representation.

Clause 24 includes the device of any of Clause 20 to Clause 23, wherein the multi-channel audio representation corresponds to ambisonics data.

Clause 25 includes the device of any of Clause 1, Clause 13, or Clause 14 further including a modem coupled to the one or more processors, the modem configured to provide audio data to the one or more processors based on received streaming data, wherein the one or more processors are configured to decode the audio data to generate the first audio signals and the second audio signals.

Clause 26 includes the device of Clause 1 or any of Clause 15 to Clause 25, wherein the one or more processors are integrated into a vehicle, and wherein the one or more processors are configured to: apply the spatial filtering based on a first location of a first occupant of the vehicle; and provide the first output signal and the second output signal to a first speaker and a second speaker, respectively, to play out the audio zoomed signal to a second occupant of the vehicle.

Clause 27 includes the device of Clause 26, wherein the one or more processors are configured to: position a movable mounting structure based on the first location of the first occupant; and receive the first audio signals and the second audio signals from a plurality of microphones mounted on the movable mounting structure.

Clause 28 includes the device of Clause 27, wherein the movable mounting structure includes a rearview mirror.

Clause 29 includes the device of Clause 27 or Clause 28, wherein the one or more processors are configured to apply the spatial filtering based on a zoom direction, a zoom depth, a configuration of the plurality of microphones, a head orientation of the second occupant, or a combination thereof.

Clause 30 includes the device of Clause 29, wherein the zoom direction, the zoom depth, or both, are based on the first location of the first occupant.

Clause 31 includes the device of Clause 27 or Clause 28, wherein the one or more processors are configured to apply the spatial filtering based on a zoom direction.

Clause 32 includes the device of Clause 31, wherein the zoom direction is based on the first location of the first occupant.

Clause 33 includes the device of Clause 27 or Clause 28, wherein the one or more processors are configured to apply the spatial filtering based on a zoom depth.

Clause 34 includes the device of Clause 33, wherein the zoom depth is based on the first location of the first occupant.

Clause 35 includes the device of Clause 27 or Clause 28, wherein the one or more processors are configured to apply the spatial filtering based on a configuration of the plurality of microphones.

Clause 36 includes the device of Clause 27 or Clause 28, wherein the one or more processors are configured to apply the spatial filtering based on a head orientation of the second occupant.

Clause 37 includes the device of any of Clause 29 or Clause 30, further including an input device coupled to the one or more processors, wherein the one or more processors are configured to receive, via the input device, a user input indicating the zoom direction, the zoom depth, the first location of the first occupant, or a combination thereof.

Clause 38 includes the device of any of Clause 29 or Clause 30, further including an input device coupled to the one or more processors, wherein the one or more processors are configured to receive, via the input device, a user input indicating the zoom direction.

Clause 39 includes the device of any of Clause 29 or Clause 30, further including an input device coupled to the one or more processors, wherein the one or more processors are configured to receive, via the input device, a user input indicating the zoom depth.

Clause 40 includes the device of any of Clause 29 or Clause 30, further including an input device coupled to the one or more processors, wherein the one or more processors are configured to receive, via the input device, a user input indicating the first location of the first occupant.

Clause 41 includes the device of any of Clause 1 to Clause 40, wherein the magnitude of the enhanced audio signal is combined with the first phase based on a first magnitude of the first audio signal and a second magnitude of the second audio signal.

Clause 42 includes the device of any of Clause 1 to Clause 41, wherein the magnitude of the enhanced audio signal is combined with the second phase based on a first magnitude of the first audio signal and a second magnitude of the second audio signal.

Clause 43 includes the device of any of Clause 1 to Clause 42, wherein the audio zoomed signal includes a binaural audio zoomed signal.

Clause 44 includes the device of any of Clause 1 to Clause 43, wherein the one or more processors are configured to apply the spatial filtering based on a zoom direction, a zoom depth, or both.

Clause 45 includes the device of Clause 44, wherein the one or more processors are configured to receive a user input indicating the zoom direction, the zoom depth, or both.

Clause 46 includes the device of Clause 44, further including a depth sensor coupled to the one or more processors, wherein the one or more processors are configured to: receive a user input indicating a zoom target; receive sensor data from the depth sensor; and determine, based on the sensor data, the zoom direction, the zoom depth, or both, of the zoom target.

Clause 47 includes the device of Clause 46, wherein the depth sensor includes an image sensor, wherein the sensor data includes image data, and wherein the one or more processors are configured to perform image recognition on the image data to determine the zoom direction, the zoom depth, or both, of the zoom target.

Clause 48 includes the device of Clause 46, wherein the depth sensor includes an ultrasound sensor, a stereo camera, a time-of-flight sensor, an antenna, or a combination thereof.

Clause 49 includes the device of Clause 48, wherein the depth sensor includes a position sensor, wherein the sensor data includes position data indicating a position of the zoom target, and wherein the one or more processors are configured to determine the zoom direction, the zoom depth, or both, of the zoom target based on the position of the zoom target.

Clause 50 includes the device of any of Clause 44 to Clause 49, wherein the one or more processors are configured to determine the zoom depth including: applying the spatial filtering to the selected audio signals based on the zoom direction and a first zoom depth to generate a first enhanced signal; applying the spatial filtering to the selected audio signals based on the zoom direction and a second zoom depth to generate a second enhanced signal; and based on determining that a first energy of the first enhanced audio signal is less than or equal to a second energy of the second enhanced audio signal, selecting the first enhanced audio signal as the enhanced audio signal and the first zoom depth as the zoom depth.

Clause 51 includes the device of Clause 50, wherein applying the spatial filtering based on the zoom direction and the first zoom depth includes applying the spatial filtering based on a first set of directions of arrival, and wherein applying the spatial filtering based on the zoom direction and the second zoom depth includes applying the spatial filtering based on a second set of directions of arrival.

Clause 52 includes the device of any of Clause 44 to Clause 51, wherein the one or more processors are configured to select the selected audio signals based on the zoom direction, the zoom depth, or both.

Clause 53 includes the device of any of Clause 1 to Clause 43, wherein the one or more processors are configured to apply the spatial filtering based on a zoom direction.

Clause 54 includes the device of Clause 53, wherein the one or more processors are configured to receive a user input indicating the zoom direction.

Clause 55 includes the device of Clause 53, further including a depth sensor coupled to the one or more processors, wherein the one or more processors are configured to: receive a user input indicating a zoom target; receive sensor data from the depth sensor; and determine, based on the sensor data, the zoom direction of the zoom target.

Clause 56 includes the device of Clause 55, wherein the depth sensor includes an image sensor, wherein the sensor data includes image data, and wherein the one or more processors are configured to perform image recognition on the image data to determine the zoom direction of the zoom target.

Clause 57 includes the device of Clause 55, wherein the depth sensor includes an ultrasound sensor, a stereo camera, a time-of-flight sensor, an antenna, or a combination thereof.

Clause 58 includes the device of Clause 55, wherein the depth sensor includes a position sensor, wherein the sensor data includes position data indicating a position of the zoom target, and wherein the one or more processors are configured to determine the zoom direction of the zoom target based on the position of the zoom target.

Clause 59 includes the device of any of Clause 53 to Clause 58, wherein the one or more processors are configured to determine a zoom depth including: applying the spatial filtering to the selected audio signals based on the zoom direction and a first zoom depth to generate a first enhanced signal; applying the spatial filtering to the selected audio signals based on the zoom direction and a second zoom depth to generate a second enhanced signal; and based on determining that a first energy of the first enhanced audio signal is less than or equal to a second energy of the second enhanced audio signal, selecting the first enhanced audio signal as the enhanced audio signal and the first zoom depth as the zoom depth.

Clause 60 includes the device of Clause 59, wherein applying the spatial filtering based on the zoom direction and the first zoom depth includes applying the spatial filtering based on a first set of directions of arrival, and wherein applying the spatial filtering based on the zoom direction and the second zoom depth includes applying the spatial filtering based on a second set of directions of arrival.

Clause 61 includes the device of any of Clause 53 to Clause 60, wherein the one or more processors are configured to select the selected audio signals based on the zoom direction.

Clause 62 includes the device of any of Clause 1 to Clause 43, wherein the one or more processors are configured to apply the spatial filtering based on a zoom depth.

Clause 63 includes the device of Clause 62, wherein the one or more processors are configured to receive a user input indicating the zoom depth.

Clause 64 includes the device of Clause 62, further including a depth sensor coupled to the one or more processors, wherein the one or more processors are configured to: receive a user input indicating a zoom target; receive sensor data from the depth sensor; and determine, based on the sensor data, the zoom depth of the zoom target.

Clause 65 includes the device of Clause 64, wherein the depth sensor includes an image sensor, wherein the sensor data includes image data, and wherein the one or more processors are configured to perform image recognition on the image data to determine the zoom depth of the zoom target.

Clause 66 includes the device of Clause 64, wherein the depth sensor includes an ultrasound sensor, a stereo camera, a time-of-flight sensor, an antenna, or a combination thereof.

Clause 67 includes the device of Clause 64, wherein the depth sensor includes a position sensor, wherein the sensor data includes position data indicating a position of the zoom target, and wherein the one or more processors are configured to determine the zoom depth of the zoom target based on the position of the zoom target.

Clause 68 includes the device of any of Clause 62 to Clause 67, wherein the one or more processors are configured to determine the zoom depth including: applying the spatial filtering to the selected audio signals based on a zoom direction and a first zoom depth to generate a first enhanced signal; applying the spatial filtering to the selected audio signals based on the zoom direction and a second zoom depth to generate a second enhanced signal; and based on determining that a first energy of the first enhanced audio signal is less than or equal to a second energy of the second enhanced audio signal, selecting the first enhanced audio signal as the enhanced audio signal and the first zoom depth as the zoom depth.

Clause 69 includes the device of Clause 68, wherein applying the spatial filtering based on the zoom direction and the first zoom depth includes applying the spatial filtering based on a first set of directions of arrival, and wherein applying the spatial filtering based on the zoom direction and the second zoom depth includes applying the spatial filtering based on a second set of directions of arrival.

Clause 70 includes the device of any of Clause 62 to Clause 69, wherein the one or more processors are configured to select the selected audio signals based on the zoom depth.

Clause 71 includes the device of any of Clause 1 to Clause 70, wherein the one or more processors are configured to: apply the spatial filtering to a first subset of the selected audio signals to generate a first enhanced audio signal; apply the spatial filtering to a second subset of the selected audio signals to generate a second enhanced audio signal; and select one of the first enhanced audio signal or the second enhanced audio signal as the enhanced audio signal based on determining that a first energy of the enhanced audio signal is less than or equal to a second energy of the other of the first enhanced audio signal or the second enhanced audio signal.

Clause 72 includes the device of Clause 71, wherein the one or more processors are configured to apply the spatial filtering to one of the first subset or the second subset with head shade effect correction.

Clause 73 includes the device of Clause 71, wherein the one or more processors are configured to apply the spatial filtering to the first subset with head shade effect correction.

Clause 74 includes the device of Clause 71, wherein the one or more processors are configured to apply the spatial filtering to the second subset with head shade effect correction.

Clause 75 includes the device of any of Clause 1 to Clause 74, wherein the first phase is indicated by first phase values, and wherein each of the first phase values represents a phase of a particular frequency subband of the first audio signal.

Clause 76 includes the device of any of Clause 1 to Clause 75, wherein the one or more processors are configured to generate each of the first output signal and the second output signal based at least in part on a first magnitude of the first audio signal, wherein the first magnitude is indicated by first magnitude values, and wherein each of the first magnitude values represents a magnitude of a particular frequency subband of the first audio signal.

Clause 77 includes the device of any of Clause 1 to Clause 76, wherein the magnitude of the enhanced audio signal is indicated by third magnitude values, and wherein each of the third magnitude values represents a magnitude of a particular frequency subband of the enhanced audio signal.

According to Clause 78, a method includes: determining, at a device, a first phase based on a first audio signal of first audio signals; determining, at the device, a second phase based on a second audio signal of second audio signals; applying, at the device, spatial filtering to selected audio signals of the first audio signals and the second audio signals to generate an enhanced audio signal; generating, at the device, a first output signal including combining a magnitude of the enhanced audio signal with the first phase; and generating, at the device, a second output signal including combining the magnitude of the enhanced audio signal with the second phase, wherein the first output signal and the second output signal correspond to an audio zoomed signal.

Clause 79 includes the method of Clause 78, further including: receiving the first audio signals from a first plurality of microphones mounted externally to a first earpiece of a headset; and receiving the second audio signals from a second plurality of microphones mounted externally to a second earpiece of the headset.

Clause 80 includes the method of Clause 79, further including applying the spatial filtering based on a zoom direction, a zoom depth, a configuration of the first plurality of microphones and the second plurality of microphones, or a combination thereof.

Clause 81 includes the method of Clause 80, further including determining the zoom direction, the zoom depth, or both, based on a tap detected via a touch sensor of the headset.

Clause 82 includes the method of Clause 80 or Clause 81, further including determining the zoom direction, the zoom depth, or both, based on a movement of the headset.

Clause 83 includes the method of Clause 79, further including applying the spatial filtering based on a zoom direction.

Clause 84 includes the method of Clause 83, further including determining the zoom direction based on a tap detected via a touch sensor of the headset.

Clause 85 includes the method of Clause 83 or Clause 84, further including determining the zoom direction based on a movement of the headset.

Clause 86 includes the method of Clause 79, further including applying the spatial filtering based on a zoom depth.

Clause 87 includes the method of Clause 86, further including determining the zoom depth based on a tap detected via a touch sensor of the headset.

Clause 88 includes the method of Clause 86 or Clause 87, further including determining the zoom depth based on a movement of the headset.

Clause 89 includes the method of Clause 79, further including applying the spatial filtering based on a configuration of the first plurality of microphones and the second plurality of microphones.

Clause 90 includes the method of any of Clause 78 to Clause 89, wherein the device is integrated in a headset.

Clause 91 includes the method of any of Clause 78 to Clause 90, further including: providing the first output signal to a first speaker of a first earpiece of a headset; and providing the second output signal to a second speaker of a second earpiece of the headset.

Clause 92 includes the method of Clause 78 or Clause 91, further including decoding audio data of a playback file to generate the first audio signals and the second audio signals.

Clause 93 includes the method of Clause 92, wherein the audio data includes position information indicating positions of sources of each of the first audio signals and the second audio signals, and further including applying the spatial filtering based on a zoom direction, a zoom depth, the position information, or a combination thereof.

Clause 94 includes the method of Clause 92, wherein the audio data includes position information indicating positions of sources of each of the first audio signals and the second audio signals, and further including applying the spatial filtering based on a zoom direction.

Clause 95 includes the method of Clause 92, wherein the audio data includes position information indicating positions of sources of each of the first audio signals and the second audio signals, and further including applying the spatial filtering based on a zoom depth.

Clause 96 includes the method of Clause 92, wherein the audio data includes position information indicating positions of sources of each of the first audio signals and the second audio signals, and further including applying the spatial filtering based on the position information.

Clause 97 includes the method of Clause 92, wherein the audio data includes a multi-channel audio representation of one or more audio sources, and further including applying the spatial filtering based on a zoom direction, a zoom depth, the multi-channel audio representation, or a combination thereof.

Clause 98 includes the method of Clause 92, wherein the audio data includes a multi-channel audio representation of one or more audio sources, and further including applying the spatial filtering based on a zoom direction.

Clause 99 includes the method of Clause 92, wherein the audio data includes a multi-channel audio representation of one or more audio sources, and further including applying the spatial filtering based on a zoom depth.

Clause 100 includes the method of Clause 92, wherein the audio data includes a multi-channel audio representation of one or more audio sources, and further including applying the spatial filtering based on the multi-channel audio representation.

Clause 101 includes the method of any of Clause 97 to Clause 100, wherein the multi-channel audio representation corresponds to ambisonics data.

Clause 102 includes the method of any of Clause 78, Clause 90, or Clause 91 further including: receiving, from a modem, audio data representing streaming data; and decoding the audio data to generate the first audio signals and the second audio signals.

Clause 103 includes the method of Clause 78 or any of Clause 92 to Clause 102, further including: applying the spatial filtering based on a first location of a first occupant of a vehicle; and providing the first output signal and the second output signal to a first speaker and a second speaker, respectively, to play out the audio zoomed signal to a second occupant of the vehicle.

Clause 104 includes the method of Clause 103, further including: positioning a movable mounting structure based on the first location of the first occupant; and receiving the first audio signals and the second audio signals from a plurality of microphones mounted on the movable mounting structure.

Clause 105 includes the method of Clause 104, wherein the movable mounting structure includes a rearview mirror.

Clause 106 includes the method of Clause 104 or Clause 105, further including applying the spatial filtering based on a zoom direction, a zoom depth, a configuration of the plurality of microphones, a head orientation of the second occupant, or a combination thereof.

Clause 107 includes the method of Clause 106, wherein the zoom direction, the zoom depth, or both, are based on the first location of the first occupant.

Clause 108 includes the method of Clause 104 or Clause 105, further including applying the spatial filtering based on a zoom direction.

Clause 109 includes the method of Clause 108, wherein the zoom direction is based on the first location of the first occupant.

Clause 110 includes the method of Clause 104 or Clause 105, further including applying the spatial filtering based on a zoom depth.

Clause 111 includes the method of Clause 110, wherein the zoom depth is based on the first location of the first occupant.

Clause 112 includes the method of Clause 104 or Clause 105, further including applying the spatial filtering based on a configuration of the plurality of microphones.

Clause 113 includes the method of Clause 104 or Clause 105, further including applying the spatial filtering based on a head orientation of the second occupant.

Clause 114 includes the method of any of Clause 106 or Clause 107, further including receiving, via an input device, a user input indicating the zoom direction, the zoom depth, the first location of the first occupant, or a combination thereof.

Clause 115 includes the method of any of Clause 106 or Clause 107, further including receiving, via an input device, a user input indicating the zoom direction.

Clause 116 includes the method of any of Clause 106 or Clause 107, further including receiving, via an input device, a user input indicating the zoom depth.

Clause 117 includes the method of any of Clause 106 or Clause 107, further including receiving, via an input device, a user input indicating the first location of the first occupant.

Clause 118 includes the method of any of Clause 78 to Clause 117, wherein the magnitude of the enhanced audio signal is combined with the first phase based on a first magnitude of the first audio signal and a second magnitude of the second audio signal.

Clause 119 includes the method of any of Clause 78 to Clause 118, wherein the magnitude of the enhanced audio signal is combined with the second phase based on a first magnitude of the first audio signal and a second magnitude of the second audio signal.

Clause 120 includes the method of any of Clause 78 to Clause 119, wherein the audio zoomed signal includes a binaural audio zoomed signal.

Clause 121 includes the method of any of Clause 78 to Clause 120, further including applying the spatial filtering based on a zoom direction, a zoom depth, or both.

Clause 122 includes the method of Clause 121, further including receiving a user input indicating the zoom direction, the zoom depth, or both.

Clause 123 includes the method of Clause 121, further including: receiving a user input indicating a zoom target; receiving sensor data from a depth sensor; and determining, based on the sensor data, the zoom direction, the zoom depth, or both, of the zoom target.

Clause 124 includes the method of Clause 123, wherein the depth sensor includes an image sensor, wherein the sensor data includes image data, and further including perform image recognition on the image data to determine the zoom direction, the zoom depth, or both, of the zoom target.

Clause 125 includes the method of Clause 123, wherein the depth sensor includes an ultrasound sensor, a stereo camera, a time-of-flight sensor, an antenna, or a combination thereof.

Clause 126 includes the method of Clause 125, wherein the depth sensor includes a position sensor, wherein the sensor data includes position data indicating a position of the zoom target, and further including determining the zoom direction, the zoom depth, or both, of the zoom target based on the position of the zoom target.

Clause 127 includes the method of any of Clause 121 to Clause 126, further including determining the zoom depth including: applying the spatial filtering to the selected audio signals based on the zoom direction and a first zoom depth to generate a first enhanced signal; applying the spatial filtering to the selected audio signals based on the zoom direction and a second zoom depth to generate a second enhanced signal; and based on determining that a first energy of the first enhanced audio signal is less than or equal to a second energy of the second enhanced audio signal, selecting the first enhanced audio signal as the enhanced audio signal and the first zoom depth as the zoom depth.

Clause 128 includes the method of Clause 127, wherein applying the spatial filtering based on the zoom direction and the first zoom depth includes applying the spatial filtering based on a first set of directions of arrival, and wherein applying the spatial filtering based on the zoom direction and the second zoom depth includes applying the spatial filtering based on a second set of directions of arrival.

Clause 129 includes the method of any of Clause 121 to Clause 128, further including selecting the selected audio signals based on the zoom direction, the zoom depth, or both.

Clause 130 includes the method of any of Clause 78 to Clause 120, further including applying the spatial filtering based on a zoom direction.

Clause 131 includes the method of Clause 130, further including receiving a user input indicating the zoom direction.

Clause 132 includes the method of Clause 130, further including: receiving a user input indicating a zoom target; receiving sensor data from a depth sensor; and determining, based on the sensor data, the zoom direction of the zoom target.

Clause 133 includes the method of Clause 132, wherein the depth sensor includes an image sensor, wherein the sensor data includes image data, and further including performing image recognition on the image data to determine the zoom direction of the zoom target.

Clause 134 includes the method of Clause 132, wherein the depth sensor includes an ultrasound sensor, a stereo camera, a time-of-flight sensor, an antenna, or a combination thereof.

Clause 135 includes the method of Clause 132, wherein the depth sensor includes a position sensor, wherein the sensor data includes position data indicating a position of the zoom target, and further including determining the zoom direction of the zoom target based on the position of the zoom target.

Clause 136 includes the method of any of Clause 130 to Clause 135, further including determining a zoom depth including: applying the spatial filtering to the selected audio signals based on the zoom direction and a first zoom depth to generate a first enhanced signal; applying the spatial filtering to the selected audio signals based on the zoom direction and a second zoom depth to generate a second enhanced signal; and based on determining that a first energy of the first enhanced audio signal is less than or equal to a second energy of the second enhanced audio signal, selecting the first enhanced audio signal as the enhanced audio signal and the first zoom depth as the zoom depth.

Clause 137 includes the method of Clause 136, wherein applying the spatial filtering based on the zoom direction and the first zoom depth includes applying the spatial filtering based on a first set of directions of arrival, and wherein applying the spatial filtering based on the zoom direction and the second zoom depth includes applying the spatial filtering based on a second set of directions of arrival.

Clause 138 includes the method of any of Clause 130 to Clause 137, further including selecting the selected audio signals based on the zoom direction.

Clause 139 includes the method of any of Clause 78 to Clause 120, further including applying the spatial filtering based on a zoom depth.

Clause 140 includes the method of Clause 139, further including receiving a user input indicating the zoom depth.

Clause 141 includes the method of Clause 139, further including: receiving a user input indicating a zoom target; receiving sensor data from a depth sensor; and determining, based on the sensor data, the zoom depth of the zoom target.

Clause 142 includes the method of Clause 141, wherein the depth sensor includes an image sensor, wherein the sensor data includes image data, and further including perform image recognition on the image data to determine the zoom depth of the zoom target.

Clause 143 includes the method of Clause 141, wherein the depth sensor includes an ultrasound sensor, a stereo camera, a time-of-flight sensor, an antenna, or a combination thereof.

Clause 144 includes the method of Clause 141, wherein the depth sensor includes a position sensor, wherein the sensor data includes position data indicating a position of the zoom target, and further including determining the zoom depth of the zoom target based on the position of the zoom target.

Clause 145 includes the method of any of Clause 139 to Clause 144, further including determining the zoom depth including: applying the spatial filtering to the selected audio signals based on a zoom direction and a first zoom depth to generate a first enhanced signal; applying the spatial filtering to the selected audio signals based on the zoom direction and a second zoom depth to generate a second enhanced signal; and based on determining that a first energy of the first enhanced audio signal is less than or equal to a second energy of the second enhanced audio signal, selecting the first enhanced audio signal as the enhanced audio signal and the first zoom depth as the zoom depth.

Clause 146 includes the method of Clause 145, wherein applying the spatial filtering based on the zoom direction and the first zoom depth includes applying the spatial filtering based on a first set of directions of arrival, and wherein applying the spatial filtering based on the zoom direction and the second zoom depth includes applying the spatial filtering based on a second set of directions of arrival.

Clause 147 includes the method of any of Clause 139 to Clause 146, further including select the selected audio signals based on the zoom depth.

Clause 148 includes the method of any of Clause 78 to Clause 147, further including: applying the spatial filtering to a first subset of the selected audio signals to generate a first enhanced audio signal; applying the spatial filtering to a second subset of the selected audio signals to generate a second enhanced audio signal; and select one of the first enhanced audio signal or the second enhanced audio signal as the enhanced audio signal based on determining that a first energy of the enhanced audio signal is less than or equal to a second energy of the other of the first enhanced audio signal or the second enhanced audio signal.

Clause 149 includes the method of Clause 148, further including applying the spatial filtering to one of the first subset or the second subset with head shade effect correction.

Clause 150 includes the method of Clause 148, further including applying the spatial filtering to the first subset with head shade effect correction.

Clause 151 includes the method of Clause 148, further including applying the spatial filtering to the second subset with head shade effect correction.

Clause 152 includes the method of any of Clause 78 to Clause 151, wherein the first phase is indicated by first phase values, and wherein each of the first phase values represents a phase of a particular frequency subband of the first audio signal.

Clause 153 includes the method of any of Clause 78 to Clause 152, further including generating each of the first output signal and the second output signal based at least in part on a first magnitude of the first audio signal, wherein the first magnitude is indicated by first magnitude values, and wherein each of the first magnitude values represents a magnitude of a particular frequency subband of the first audio signal.

Clause 154 includes the method of any of Clause 78 to Clause 153, wherein the magnitude of the enhanced audio signal is indicated by third magnitude values, and wherein each of the third magnitude values represents a magnitude of a particular frequency subband of the enhanced audio signal.

According to Clause 155, a non-transitory computer-readable medium stores instructions that, when executed by one or more processors, cause the one or more processors to: determine a first phase based on a first audio signal of first audio signals; determine a second phase based on a second audio signal of second audio signals; apply spatial filtering to selected audio signals of the first audio signals and the second audio signals to generate an enhanced audio signal; generate a first output signal including combining a magnitude of the enhanced audio signal with the first phase; and generate a second output signal including combining the magnitude of the enhanced audio signal with the second phase, wherein the first output signal and the second output signal correspond to an audio zoomed signal.

Clause 156 includes the non-transitory computer-readable medium of Clause 155, wherein the instructions, when executed by the one or more processors, further cause the one or more processors to: receive the first audio signals from a first plurality of microphones mounted externally to a first earpiece of a headset; and receiving the second audio signals from a second plurality of microphones mounted externally to a second earpiece of the headset.

Clause 157 includes the non-transitory computer-readable medium of Clause 156, wherein the instructions, when executed by the one or more processors, further cause the one or more processors to apply the spatial filtering based on a zoom direction, a zoom depth, a configuration of the first plurality of microphones and the second plurality of microphones, or a combination thereof.

Clause 158 includes the non-transitory computer-readable medium of Clause 157, wherein the instructions, when executed by the one or more processors, further cause the one or more processors to determine the zoom direction, the zoom depth, or both, based on a tap detected via a touch sensor of the headset.

Clause 159 includes the non-transitory computer-readable medium of Clause 157 or Clause 158, wherein the instructions, when executed by the one or more processors, further cause the one or more processors to determine the zoom direction, the zoom depth, or both, based on a movement of the headset.

Clause 160 includes the non-transitory computer-readable medium of Clause 156, wherein the instructions, when executed by the one or more processors, further cause the one or more processors to apply the spatial filtering based on a zoom direction.

Clause 161 includes the non-transitory computer-readable medium of Clause 160, wherein the instructions, when executed by the one or more processors, further cause the one or more processors to determine the zoom direction based on a tap detected via a touch sensor of the headset.

Clause 162 includes the non-transitory computer-readable medium of Clause 160 or Clause 161, wherein the instructions, when executed by the one or more processors, further cause the one or more processors to determine the zoom direction based on a movement of the headset.

Clause 163 includes the non-transitory computer-readable medium of Clause 156, wherein the instructions, when executed by the one or more processors, further cause the one or more processors to apply the spatial filtering based on a zoom depth.

Clause 164 includes the non-transitory computer-readable medium of Clause 163, wherein the instructions, when executed by the one or more processors, further cause the one or more processors to determine the zoom depth based on a tap detected via a touch sensor of the headset.

Clause 165 includes the non-transitory computer-readable medium of Clause 163 or Clause 164, wherein the instructions, when executed by the one or more processors, further cause the one or more processors to determine the zoom depth based on a movement of the headset.

Clause 166 includes the non-transitory computer-readable medium of Clause 156, wherein the instructions, when executed by the one or more processors, further cause the one or more processors to apply the spatial filtering based on a configuration of the first plurality of microphones and the second plurality of microphones.

Clause 167 includes the non-transitory computer-readable medium of any of Clause 155 to Clause 166, wherein the one or more processors are integrated in a headset.

Clause 168 includes the non-transitory computer-readable medium of any of Clause 155 to Clause 167, wherein the instructions, when executed by the one or more processors, further cause the one or more processors to: provide the first output signal to a first speaker of a first earpiece of a headset; and provide the second output signal to a second speaker of a second earpiece of the headset.

Clause 169 includes the non-transitory computer-readable medium of Clause 155 or Clause 168, wherein the instructions, when executed by the one or more processors, further cause the one or more processors to decode audio data of a playback file to generate the first audio signals and the second audio signals.

Clause 170 includes the non-transitory computer-readable medium of Clause 169, wherein the audio data includes position information indicating positions of sources of each of the first audio signals and the second audio signals, and wherein the instructions, when executed by the one or more processors, further cause the one or more processors to apply the spatial filtering based on a zoom direction, a zoom depth, the position information, or a combination thereof.

Clause 171 includes the non-transitory computer-readable medium of Clause 169, wherein the audio data includes position information indicating positions of sources of each of the first audio signals and the second audio signals, and wherein the instructions, when executed by the one or more processors, further cause the one or more processors to apply the spatial filtering based on a zoom direction.

Clause 172 includes the non-transitory computer-readable medium of Clause 169, wherein the audio data includes position information indicating positions of sources of each of the first audio signals and the second audio signals, and wherein the instructions, when executed by the one or more processors, further cause the one or more processors to apply the spatial filtering based on a zoom depth.

Clause 173 includes the non-transitory computer-readable medium of Clause 169, wherein the audio data includes position information indicating positions of sources of each of the first audio signals and the second audio signals, and wherein the instructions, when executed by the one or more processors, further cause the one or more processors to apply the spatial filtering based on the position information.

Clause 174 includes the non-transitory computer-readable medium of Clause 169, wherein the audio data includes a multi-channel audio representation of one or more audio sources, and wherein the instructions, when executed by the one or more processors, further cause the one or more processors to apply the spatial filtering based on a zoom direction, a zoom depth, the multi-channel audio representation, or a combination thereof.

Clause 175 includes the non-transitory computer-readable medium of Clause 169, wherein the audio data includes a multi-channel audio representation of one or more audio sources, and wherein the instructions, when executed by the one or more processors, further cause the one or more processors to apply the spatial filtering based on a zoom direction.

Clause 176 includes the non-transitory computer-readable medium of Clause 169, wherein the audio data includes a multi-channel audio representation of one or more audio sources, and wherein the instructions, when executed by the one or more processors, further cause the one or more processors to apply the spatial filtering based on a zoom depth.

Clause 177 includes the non-transitory computer-readable medium of Clause 169, wherein the audio data includes a multi-channel audio representation of one or more audio sources, and wherein the instructions, when executed by the one or more processors, further cause the one or more processors to apply the spatial filtering based on the multi-channel audio representation.

Clause 178 includes the non-transitory computer-readable medium of any of Clause 174 to Clause 177, wherein the multi-channel audio representation corresponds to ambisonics data.

Clause 179 includes the non-transitory computer-readable medium of any of Clause 155, Clause 167, or Clause 168 wherein the instructions, when executed by the one or more processors, further cause the one or more processors to: receive, from a modem, audio data representing streaming data; and decode the audio data to generate the first audio signals and the second audio signals.

Clause 180 includes the non-transitory computer-readable medium of Clause 155 or any of Clause 169 to Clause 179, wherein the instructions, when executed by the one or more processors, further cause the one or more processors to: apply the spatial filtering based on a first location of a first occupant of a vehicle; and provide the first output signal and the second output signal to a first speaker and a second speaker, respectively, to play out the audio zoomed signal to a second occupant of the vehicle.

Clause 181 includes the non-transitory computer-readable medium of Clause 180, wherein the instructions, when executed by the one or more processors, further cause the one or more processors to: position a movable mounting structure based on the first location of the first occupant; and receive the first audio signals and the second audio signals from a plurality of microphones mounted on the movable mounting structure.

Clause 182 includes the non-transitory computer-readable medium of Clause 181, wherein the movable mounting structure includes a rearview mirror.

Clause 183 includes the non-transitory computer-readable medium of Clause 181 or Clause 182, wherein the instructions, when executed by the one or more processors, further cause the one or more processors to apply the spatial filtering based on a zoom direction, a zoom depth, a configuration of the plurality of microphones, a head orientation of the second occupant, or a combination thereof.

Clause 184 includes the non-transitory computer-readable medium of Clause 183, wherein the zoom direction, the zoom depth, or both, are based on the first location of the first occupant.

Clause 185 includes the non-transitory computer-readable medium of Clause 181 or Clause 182, wherein the instructions, when executed by the one or more processors, further cause the one or more processors to apply the spatial filtering based on a zoom direction.

Clause 186 includes the non-transitory computer-readable medium of Clause 185, wherein the zoom direction is based on the first location of the first occupant.

Clause 187 includes the non-transitory computer-readable medium of Clause 181 or Clause 182, wherein the instructions, when executed by the one or more processors, further cause the one or more processors to apply the spatial filtering based on a zoom depth.

Clause 188 includes the non-transitory computer-readable medium of Clause 187, wherein the zoom depth is based on the first location of the first occupant.

Clause 189 includes the non-transitory computer-readable medium of Clause 181 or Clause 182, wherein the instructions, when executed by the one or more processors, further cause the one or more processors to apply the spatial filtering based on a configuration of the plurality of microphones.

Clause 190 includes the non-transitory computer-readable medium of Clause 181 or Clause 182, wherein the instructions, when executed by the one or more processors, further cause the one or more processors to apply the spatial filtering based on a head orientation of the second occupant.

Clause 191 includes the non-transitory computer-readable medium of any of Clause 183 or Clause 184, wherein the instructions, when executed by the one or more processors, further cause the one or more processors to receive, via an input device, a user input indicating the zoom direction, the zoom depth, the first location of the first occupant, or a combination thereof.

Clause 192 includes the non-transitory computer-readable medium of any of Clause 183 or Clause 184, wherein the instructions, when executed by the one or more processors, further cause the one or more processors to receive, via an input device, a user input indicating the zoom direction.

Clause 193 includes the non-transitory computer-readable medium of any of Clause 183 or Clause 184, wherein the instructions, when executed by the one or more processors, further cause the one or more processors to receive, via an input device, a user input indicating the zoom depth.

Clause 194 includes the non-transitory computer-readable medium of any of Clause 183 or Clause 184, wherein the instructions, when executed by the one or more processors, further cause the one or more processors to receive, via an input device, a user input indicating the first location of the first occupant.

Clause 195 includes the non-transitory computer-readable medium of any of Clause 155 to Clause 194, wherein the magnitude of the enhanced audio signal is combined with the first phase based on a first magnitude of the first audio signal and a second magnitude of the second audio signal.

Clause 196 includes the non-transitory computer-readable medium of any of Clause 155 to Clause 195, wherein the magnitude of the enhanced audio signal is combined with the second phase based on a first magnitude of the first audio signal and a second magnitude of the second audio signal.

Clause 197 includes the non-transitory computer-readable medium of any of Clause 155 to Clause 196, wherein the audio zoomed signal includes a binaural audio zoomed signal.

Clause 198 includes the non-transitory computer-readable medium of any of Clause 155 to Clause 197, wherein the instructions, when executed by the one or more processors, further cause the one or more processors to apply the spatial filtering based on a zoom direction, a zoom depth, or both.

Clause 199 includes the non-transitory computer-readable medium of Clause 198, wherein the instructions, when executed by the one or more processors, further cause the one or more processors to receive a user input indicating the zoom direction, the zoom depth, or both.

Clause 200 includes the non-transitory computer-readable medium of Clause 198, wherein the instructions, when executed by the one or more processors, further cause the one or more processors to: receive a user input indicating a zoom target; receive sensor data from a depth sensor; and determine, based on the sensor data, the zoom direction, the zoom depth, or both, of the zoom target.

Clause 201 includes the non-transitory computer-readable medium of Clause 200, wherein the depth sensor includes an image sensor, wherein the sensor data includes image data, and wherein the instructions, when executed by the one or more processors, further cause the one or more processors to perform image recognition on the image data to determine the zoom direction, the zoom depth, or both, of the zoom target.

Clause 202 includes the non-transitory computer-readable medium of Clause 200, wherein the depth sensor includes an ultrasound sensor, a stereo camera, a time-of-flight sensor, an antenna, or a combination thereof.

Clause 203 includes the non-transitory computer-readable medium of Clause 202, wherein the depth sensor includes a position sensor, wherein the sensor data includes position data indicating a position of the zoom target, and wherein the instructions, when executed by the one or more processors, further cause the one or more processors to determine the zoom direction, the zoom depth, or both, of the zoom target based on the position of the zoom target.

Clause 204 includes the non-transitory computer-readable medium of any of Clause 198 to Clause 203, wherein the instructions, when executed by the one or more processors, further cause the one or more processors to determine the zoom depth including: applying the spatial filtering to the selected audio signals based on the zoom direction and a first zoom depth to generate a first enhanced signal; applying the spatial filtering to the selected audio signals based on the zoom direction and a second zoom depth to generate a second enhanced signal; and based on determining that a first energy of the first enhanced audio signal is less than or equal to a second energy of the second enhanced audio signal, selecting the first enhanced audio signal as the enhanced audio signal and the first zoom depth as the zoom depth.

Clause 205 includes the non-transitory computer-readable medium of Clause 204, wherein applying the spatial filtering based on the zoom direction and the first zoom depth includes applying the spatial filtering based on a first set of directions of arrival, and wherein applying the spatial filtering based on the zoom direction and the second zoom depth includes applying the spatial filtering based on a second set of directions of arrival.

Clause 206 includes the non-transitory computer-readable medium of any of Clause 198 to Clause 205, wherein the instructions, when executed by the one or more processors, further cause the one or more processors to select the selected audio signals based on the zoom direction, the zoom depth, or both.

Clause 207 includes the non-transitory computer-readable medium of any of Clause 155 to Clause 197, wherein the instructions, when executed by the one or more processors, further cause the one or more processors to apply the spatial filtering based on a zoom direction.

Clause 208 includes the non-transitory computer-readable medium of Clause 207, wherein the instructions, when executed by the one or more processors, further cause the one or more processors to receive a user input indicating the zoom direction.

Clause 209 includes the non-transitory computer-readable medium of Clause 207, wherein the instructions, when executed by the one or more processors, further cause the one or more processors to: receive a user input indicating a zoom target; receive sensor data from a depth sensor; and determine, based on the sensor data, the zoom direction of the zoom target.

Clause 210 includes the non-transitory computer-readable medium of Clause 209, wherein the depth sensor includes an image sensor, wherein the sensor data includes image data, and wherein the instructions, when executed by the one or more processors, further cause the one or more processors to perform image recognition on the image data to determine the zoom direction of the zoom target.

Clause 211 includes the non-transitory computer-readable medium of Clause 209, wherein the depth sensor includes an ultrasound sensor, a stereo camera, a time-of-flight sensor, an antenna, or a combination thereof.

Clause 212 includes the non-transitory computer-readable medium of Clause 209, wherein the depth sensor includes a position sensor, wherein the sensor data includes position data indicating a position of the zoom target, and wherein the instructions, when executed by the one or more processors, further cause the one or more processors to determine the zoom direction of the zoom target based on the position of the zoom target.

Clause 213 includes the non-transitory computer-readable medium of any of Clause 207 to Clause 212, wherein the instructions, when executed by the one or more processors, further cause the one or more processors to determine a zoom depth including: applying the spatial filtering to the selected audio signals based on the zoom direction and a first zoom depth to generate a first enhanced signal; applying the spatial filtering to the selected audio signals based on the zoom direction and a second zoom depth to generate a second enhanced signal; and based on determining that a first energy of the first enhanced audio signal is less than or equal to a second energy of the second enhanced audio signal, selecting the first enhanced audio signal as the enhanced audio signal and the first zoom depth as the zoom depth.

Clause 214 includes the non-transitory computer-readable medium of Clause 213, wherein applying the spatial filtering based on the zoom direction and the first zoom depth includes applying the spatial filtering based on a first set of directions of arrival, and wherein applying the spatial filtering based on the zoom direction and the second zoom depth includes applying the spatial filtering based on a second set of directions of arrival.

Clause 215 includes the non-transitory computer-readable medium of any of Clause 207 to Clause 214, wherein the instructions, when executed by the one or more processors, further cause the one or more processors to select the selected audio signals based on the zoom direction.

Clause 216 includes the non-transitory computer-readable medium of any of Clause 155 to Clause 197, wherein the instructions, when executed by the one or more processors, further cause the one or more processors to apply the spatial filtering based on a zoom depth.

Clause 217 includes the non-transitory computer-readable medium of Clause 216, wherein the instructions, when executed by the one or more processors, further cause the one or more processors to receive a user input indicating the zoom depth.

Clause 218 includes the non-transitory computer-readable medium of Clause 216, wherein the instructions, when executed by the one or more processors, further cause the one or more processors to: receive a user input indicating a zoom target; receive sensor data from a depth sensor; and determine, based on the sensor data, the zoom depth of the zoom target.

Clause 219 includes the non-transitory computer-readable medium of Clause 218, wherein the depth sensor includes an image sensor, wherein the sensor data includes image data, and wherein the instructions, when executed by the one or more processors, further cause the one or more processors to perform image recognition on the image data to determine the zoom depth of the zoom target.

Clause 220 includes the non-transitory computer-readable medium of Clause 218, wherein the depth sensor includes an ultrasound sensor, a stereo camera, a time-of-flight sensor, an antenna, or a combination thereof.

Clause 221 includes the non-transitory computer-readable medium of Clause 218, wherein the depth sensor includes a position sensor, wherein the sensor data includes position data indicating a position of the zoom target, and wherein the instructions, when executed by the one or more processors, further cause the one or more processors to determine the zoom depth of the zoom target based on the position of the zoom target.

Clause 222 includes the non-transitory computer-readable medium of any of Clause 216 to Clause 221, wherein the instructions, when executed by the one or more processors, further cause the one or more processors to determine the zoom depth including: applying the spatial filtering to the selected audio signals based on a zoom direction and a first zoom depth to generate a first enhanced signal; applying the spatial filtering to the selected audio signals based on the zoom direction and a second zoom depth to generate a second enhanced signal; and based on determining that a first energy of the first enhanced audio signal is less than or equal to a second energy of the second enhanced audio signal, selecting the first enhanced audio signal as the enhanced audio signal and the first zoom depth as the zoom depth.

Clause 223 includes the non-transitory computer-readable medium of Clause 222, wherein applying the spatial filtering based on the zoom direction and the first zoom depth includes applying the spatial filtering based on a first set of directions of arrival, and wherein applying the spatial filtering based on the zoom direction and the second zoom depth includes applying the spatial filtering based on a second set of directions of arrival.

Clause 224 includes the non-transitory computer-readable medium of any of Clause 216 to Clause 223, wherein the instructions, when executed by the one or more processors, further cause the one or more processors to select the selected audio signals based on the zoom depth.

Clause 225 includes the non-transitory computer-readable medium of any of Clause 155 to Clause 224, wherein the instructions, when executed by the one or more processors, further cause the one or more processors to: apply the spatial filtering to a first subset of the selected audio signals to generate a first enhanced audio signal; apply the spatial filtering to a second subset of the selected audio signals to generate a second enhanced audio signal; and select one of the first enhanced audio signal or the second enhanced audio signal as the enhanced audio signal based on determining that a first energy of the enhanced audio signal is less than or equal to a second energy of the other of the first enhanced audio signal or the second enhanced audio signal.

Clause 226 includes the non-transitory computer-readable medium of Clause 225, wherein the instructions, when executed by the one or more processors, further cause the one or more processors to apply the spatial filtering to one of the first subset or the second subset with head shade effect correction.

Clause 227 includes the non-transitory computer-readable medium of Clause 225, wherein the instructions, when executed by the one or more processors, further cause the one or more processors to apply the spatial filtering to the first subset with head shade effect correction.

Clause 228 includes the non-transitory computer-readable medium of Clause 225, wherein the instructions, when executed by the one or more processors, further cause the one or more processors to apply the spatial filtering to the second subset with head shade effect correction.

Clause 229 includes the non-transitory computer-readable medium of any of Clause 155 to Clause 228, wherein the first phase is indicated by first phase values, and wherein each of the first phase values represents a phase of a particular frequency subband of the first audio signal.

Clause 230 includes the non-transitory computer-readable medium of any of Clause 155 to Clause 229, wherein the instructions, when executed by the one or more processors, further cause the one or more processors to generate each of the first output signal and the second output signal based at least in part on a first magnitude of the first audio signal, wherein the first magnitude is indicated by first magnitude values, and wherein each of the first magnitude values represents a magnitude of a particular frequency subband of the first audio signal.

Clause 231 includes the non-transitory computer-readable medium of any of Clause 155 to Clause 230, wherein the magnitude of the enhanced audio signal is indicated by third magnitude values, and wherein each of the third magnitude values represents a magnitude of a particular frequency subband of the enhanced audio signal.

According to Clause 232, an apparatus includes: means for determining a first phase based on a first audio signal of first audio signals; means for determining a second phase based on a second audio signal of second audio signals; means for applying spatial filtering to selected audio signals of the first audio signals and the second audio signals to generate an enhanced audio signal; means for generating a first output signal including combining a magnitude of the enhanced audio signal with the first phase; and means for generating a second output signal including combining the magnitude of the enhanced audio signal with the second phase, wherein the first output signal and the second output signal correspond to an audio zoomed signal.

Clause 233 includes the apparatus of Clause 232, further including: means for receiving the first audio signals from a first plurality of microphones mounted externally to a first earpiece of a headset; and means for receiving the second audio signals from a second plurality of microphones mounted externally to a second earpiece of the headset.

Clause 234 includes the apparatus of Clause 233, further including: means for applying the spatial filtering based on a zoom direction, a zoom depth, a configuration of the first plurality of microphones and the second plurality of microphones, or a combination thereof.

Clause 235 includes the apparatus of Clause 234, further including: means for determining the zoom direction, the zoom depth, or both, based on a tap detected via a touch sensor of the headset.

Clause 236 includes the apparatus of Clause 234 or Clause 235, further including: means for determining the zoom direction, the zoom depth, or both, based on a movement of the headset.

Clause 237 includes the apparatus of Clause 233, further including: means for applying the spatial filtering based on a zoom direction.

Clause 238 includes the apparatus of Clause 237, further including: means for determining the zoom direction based on a tap detected via a touch sensor of the headset.

Clause 239 includes the apparatus of Clause 237 or Clause 238, further including: means for determining the zoom direction based on a movement of the headset.

Clause 240 includes the apparatus of Clause 233, further including: means for applying the spatial filtering based on a zoom depth.

Clause 241 includes the apparatus of Clause 240, further including: means for determining the zoom depth based on a tap detected via a touch sensor of the headset.

Clause 242 includes the apparatus of Clause 240 or Clause 241, further including: means for determining the zoom depth based on a movement of the headset.

Clause 243 includes the apparatus of Clause 233, further including: means for applying the spatial filtering based on a configuration of the first plurality of microphones and the second plurality of microphones.

Clause 244 includes the apparatus of any of Clause 232 to Clause 243, wherein the means for determining the first phase, the means for determining the second phase, the means for applying spatial filtering, the means for generating the first output signal, and the means for generating the second output signal are integrated into a headset.

Clause 245 includes the apparatus of any of Clause 232 to Clause 244, further including means for providing the first output signal to a first speaker of a first earpiece of a headset; and means for providing the second output signal to a second speaker of a second earpiece of the headset.

Clause 246 includes the apparatus of Clause 232 or Clause 245, further including means for decoding audio data of a playback file to generate the first audio signals and the second audio signals.

Clause 247 includes the apparatus of Clause 246, wherein the audio data includes position information indicating positions of sources of each of the first audio signals and the second audio signals, and further including: means for applying the spatial filtering based on a zoom direction, a zoom depth, the position information, or a combination thereof.

Clause 248 includes the apparatus of Clause 246, wherein the audio data includes position information indicating positions of sources of each of the first audio signals and the second audio signals, and further including: means for applying the spatial filtering based on a zoom direction.

Clause 249 includes the apparatus of Clause 246, wherein the audio data includes position information indicating positions of sources of each of the first audio signals and the second audio signals, and further including: means for applying the spatial filtering based on a zoom depth.

Clause 250 includes the apparatus of Clause 246, wherein the audio data includes position information indicating positions of sources of each of the first audio signals and the second audio signals, and further including: means for applying the spatial filtering based on the position information.

Clause 251 includes the apparatus of Clause 246, wherein the audio data includes a multi-channel audio representation of one or more audio sources, and further including: means for applying the spatial filtering based on a zoom direction, a zoom depth, the multi-channel audio representation, or a combination thereof.

Clause 252 includes the apparatus of Clause 246, wherein the audio data includes a multi-channel audio representation of one or more audio sources, and further including: means for applying the spatial filtering based on a zoom direction.

Clause 253 includes the apparatus of Clause 246, wherein the audio data includes a multi-channel audio representation of one or more audio sources, and further including: means for applying the spatial filtering based on a zoom depth.

Clause 254 includes the apparatus of Clause 246, wherein the audio data includes a multi-channel audio representation of one or more audio sources, and further including: means for applying the spatial filtering based on the multi-channel audio representation.

Clause 255 includes the apparatus of any of Clause 251 to Clause 254, wherein the multi-channel audio representation corresponds to ambisonics data.

Clause 256 includes the apparatus of any of Clause 232, Clause 244, or Clause 245 further including means for receiving, from a modem, audio data representing streaming data; and means for decoding the audio data to generate the first audio signals and the second audio signals.

Clause 257 includes the apparatus of Clause 232 or any of Clause 246 to Clause 256, further including: means for applying the spatial filtering based on a first location of a first occupant of a vehicle; and means for providing the first output signal and the second output signal to a first speaker and a second speaker, respectively, to play out the audio zoomed signal to a second occupant of the vehicle.

Clause 258 includes the apparatus of Clause 257, further including: means for positioning a movable mounting structure based on the first location of the first occupant; and means for receiving the first audio signals and the second audio signals from a plurality of microphones mounted on the movable mounting structure.

Clause 259 includes the apparatus of Clause 258, wherein the movable mounting structure includes a rearview mirror.

Clause 260 includes the apparatus of Clause 258 or Clause 259, further including: means for applying the spatial filtering based on a zoom direction, a zoom depth, a configuration of the plurality of microphones, a head orientation of the second occupant, or a combination thereof.

Clause 261 includes the apparatus of Clause 260, wherein the zoom direction, the zoom depth, or both, are based on the first location of the first occupant.

Clause 262 includes the apparatus of Clause 258 or Clause 259, further including: means for applying the spatial filtering based on a zoom direction.

Clause 263 includes the apparatus of Clause 262, wherein the zoom direction is based on the first location of the first occupant.

Clause 264 includes the apparatus of Clause 258 or Clause 259, further including: means for applying the spatial filtering based on a zoom depth.

Clause 265 includes the apparatus of Clause 264, wherein the zoom depth is based on the first location of the first occupant.

Clause 266 includes the apparatus of Clause 258 or Clause 259, further including: means for applying the spatial filtering based on a configuration of the plurality of microphones.

Clause 267 includes the apparatus of Clause 258 or Clause 259, further including: means for applying the spatial filtering based on a head orientation of the second occupant.

Clause 268 includes the apparatus of any of Clause 260 or Clause 261, further including: means for receiving, via an input device, a user input indicating the zoom direction, the zoom depth, the first location of the first occupant, or a combination thereof.

Clause 269 includes the apparatus of any of Clause 260 or Clause 261, further including: means for receiving, via an input device, a user input indicating the zoom direction.

Clause 270 includes the apparatus of any of Clause 260 or Clause 261, further including: means for receiving, via an input device, a user input indicating the zoom depth.

Clause 271 includes the apparatus of any of Clause 260 or Clause 261, further including an input device coupled to the one or more processors, further including: means for receiving, via an input device, a user input indicating the first location of the first occupant.

Clause 272 includes the apparatus of any of Clause 232 to Clause 271, wherein the magnitude of the enhanced audio signal is combined with the first phase based on a first magnitude of the first audio signal and a second magnitude of the second audio signal.

Clause 273 includes the apparatus of any of Clause 232 to Clause 272, wherein the magnitude of the enhanced audio signal is combined with the second phase based on a first magnitude of the first audio signal and a second magnitude of the second audio signal.

Clause 274 includes the apparatus of any of Clause 232 to Clause 273, wherein the audio zoomed signal includes a binaural audio zoomed signal.

Clause 275 includes the apparatus of any of Clause 232 to Clause 274, further including: means for applying the spatial filtering based on a zoom direction, a zoom depth, or both.

Clause 276 includes the apparatus of Clause 275, further including: means for receiving a user input indicating the zoom direction, the zoom depth, or both.

Clause 277 includes the apparatus of Clause 275, further including: means for receiving a user input indicating a zoom target; means for receiving sensor data from a depth sensor; and means for determining, based on the sensor data, the zoom direction, the zoom depth, or both, of the zoom target.

Clause 278 includes the apparatus of Clause 277, wherein the depth sensor includes an image sensor, wherein the sensor data includes image data, and further including: means for performing image recognition on the image data to determine the zoom direction, the zoom depth, or both, of the zoom target.

Clause 279 includes the apparatus of Clause 277, wherein the depth sensor includes an ultrasound sensor, a stereo camera, a time-of-flight sensor, an antenna, or a combination thereof.

Clause 280 includes the apparatus of Clause 279, wherein the depth sensor includes a position sensor, wherein the sensor data includes position data indicating a position of the zoom target, and further including: means for determining the zoom direction, the zoom depth, or both, of the zoom target based on the position of the zoom target.

Clause 281 includes the apparatus of any of Clause 275 to Clause 280, further including: means for determining the zoom depth including: means for applying the spatial filtering to the selected audio signals based on the zoom direction and a first zoom depth to generate a first enhanced signal; means for applying the spatial filtering to the selected audio signals based on the zoom direction and a second zoom depth to generate a second enhanced signal; and means for selecting, based on determining that a first energy of the first enhanced audio signal is less than or equal to a second energy of the second enhanced audio signal, the first enhanced audio signal as the enhanced audio signal and the first zoom depth as the zoom depth.

Clause 282 includes the apparatus of Clause 281, wherein means for applying the spatial filtering based on the zoom direction and the first zoom depth includes means for applying the spatial filtering based on a first set of directions of arrival, and wherein means for applying the spatial filtering based on the zoom direction and the second zoom depth includes means for applying the spatial filtering based on a second set of directions of arrival.

Clause 283 includes the apparatus of any of Clause 275 to Clause 282, further including: means for selecting the selected audio signals based on the zoom direction, the zoom depth, or both.

Clause 284 includes the apparatus of any of Clause 232 to Clause 274, further including: means for applying the spatial filtering based on a zoom direction.

Clause 285 includes the apparatus of Clause 284, further including: means for receiving a user input indicating the zoom direction.

Clause 286 includes the apparatus of Clause 284, further including: means for receiving a user input indicating a zoom target; means for receiving sensor data from a depth sensor; and means for determining, based on the sensor data, the zoom direction of the zoom target.

Clause 287 includes the apparatus of Clause 286, wherein the depth sensor includes an image sensor, wherein the sensor data includes image data, and further including: means for performing image recognition on the image data to determine the zoom direction of the zoom target.

Clause 288 includes the apparatus of Clause 286, wherein the depth sensor includes an ultrasound sensor, a stereo camera, a time-of-flight sensor, an antenna, or a combination thereof.

Clause 289 includes the apparatus of Clause 286, wherein the depth sensor includes a position sensor, wherein the sensor data includes position data indicating a position of the zoom target, and further including: means for determining the zoom direction of the zoom target based on the position of the zoom target.

Clause 290 includes the apparatus of any of Clause 284 to Clause 289, further including: means for determining a zoom depth including: means for applying the spatial filtering to the selected audio signals based on the zoom direction and a first zoom depth to generate a first enhanced signal; means for applying the spatial filtering to the selected audio signals based on the zoom direction and a second zoom depth to generate a second enhanced signal; and means for selecting, based on determining that a first energy of the first enhanced audio signal is less than or equal to a second energy of the second enhanced audio signal, the first enhanced audio signal as the enhanced audio signal and the first zoom depth as the zoom depth.

Clause 291 includes the apparatus of Clause 290, wherein the means for applying the spatial filtering based on the zoom direction and the first zoom depth includes means for applying the spatial filtering based on a first set of directions of arrival, and wherein the means for applying the spatial filtering based on the zoom direction and the second zoom depth includes means for applying the spatial filtering based on a second set of directions of arrival.

Clause 292 includes the apparatus of any of Clause 284 to Clause 291, further including: means for selecting the selected audio signals based on the zoom direction.

Clause 293 includes the apparatus of any of Clause 232 to Clause 274, further including: means for applying the spatial filtering based on a zoom depth.

Clause 294 includes the apparatus of Clause 293, further including: means for receiving a user input indicating the zoom depth.

Clause 295 includes the apparatus of Clause 293, further including: means for receiving a user input indicating a zoom target; means for receiving sensor data from a depth sensor; and means for determining, based on the sensor data, the zoom depth of the zoom target.

Clause 296 includes the apparatus of Clause 295, wherein the depth sensor includes an image sensor, wherein the sensor data includes image data, and further including: means for performing image recognition on the image data to determine the zoom depth of the zoom target.

Clause 297 includes the apparatus of Clause 295, wherein the depth sensor includes an ultrasound sensor, a stereo camera, a time-of-flight sensor, an antenna, or a combination thereof.

Clause 298 includes the apparatus of Clause 295, wherein the depth sensor includes a position sensor, wherein the sensor data includes position data indicating a position of the zoom target, and further including: means for determining the zoom depth of the zoom target based on the position of the zoom target.

Clause 299 includes the apparatus of any of Clause 293 to Clause 298, further including: means for determining the zoom depth including: means for applying the spatial filtering to the selected audio signals based on a zoom direction and a first zoom depth to generate a first enhanced signal; means for applying the spatial filtering to the selected audio signals based on the zoom direction and a second zoom depth to generate a second enhanced signal; and means for selecting, based on determining that a first energy of the first enhanced audio signal is less than or equal to a second energy of the second enhanced audio signal, the first enhanced audio signal as the enhanced audio signal and the first zoom depth as the zoom depth.

Clause 300 includes the apparatus of Clause 299, wherein the means for applying the spatial filtering based on the zoom direction and the first zoom depth includes means for applying the spatial filtering based on a first set of directions of arrival, and wherein the means for applying the spatial filtering based on the zoom direction and the second zoom depth includes means for applying the spatial filtering based on a second set of directions of arrival.

Clause 301 includes the apparatus of any of Clause 293 to Clause 300, further including: means for selecting the selected audio signals based on the zoom depth.

Clause 302 includes the apparatus of any of Clause 232 to Clause 301, further including: means for applying the spatial filtering to a first subset of the selected audio signals to generate a first enhanced audio signal; means for applying the spatial filtering to a second subset of the selected audio signals to generate a second enhanced audio signal; and means for selecting one of the first enhanced audio signal or the second enhanced audio signal as the enhanced audio signal based on determining that a first energy of the enhanced audio signal is less than or equal to a second energy of the other of the first enhanced audio signal or the second enhanced audio signal.

Clause 303 includes the apparatus of Clause 302, further including: means for applying the spatial filtering to one of the first subset or the second subset with head shade effect correction.

Clause 304 includes the apparatus of Clause 302, further including: means for applying the spatial filtering to the first subset with head shade effect correction.

Clause 305 includes the apparatus of Clause 302, further including: means for applying the spatial filtering to the second subset with head shade effect correction.

Clause 306 includes the apparatus of any of Clause 232 to Clause 305, wherein the first phase is indicated by first phase values, and wherein each of the first phase values represents a phase of a particular frequency subband of the first audio signal.

Clause 307 includes the apparatus of any of Clause 232 to Clause 306, further including: means for generating each of the first output signal and the second output signal based at least in part on a first magnitude of the first audio signal, wherein the first magnitude is indicated by first magnitude values, and wherein each of the first magnitude values represents a magnitude of a particular frequency subband of the first audio signal.

Clause 308 includes the apparatus of any of Clause 232 to Clause 307, wherein the magnitude of the enhanced audio signal is indicated by third magnitude values, and wherein each of the third magnitude values represents a magnitude of a particular frequency subband of the enhanced audio signal.

Those of skill would further appreciate that the various illustrative logical blocks, configurations, modules, circuits, and algorithm steps described in connection with the implementations disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, such implementation decisions are not to be interpreted as causing a departure from the scope of the present disclosure.

The steps of a method or algorithm described in connection with the implementations disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. An exemplary storage medium is coupled to the processor such that the processor may read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A device comprising:

a memory configured to store instructions; and one or more processors configured to execute the instructions to:

determine a first phase based on a first audio signal of first audio signals;

determine a second phase based on a second audio signal of second audio signals;

apply spatial filtering to selected audio signals of the first audio signals and the second audio signals, wherein the spatial filtering is applied to a first subset of the selected audio signals to generate a first enhanced audio signal, and wherein the spatial filtering is applied to a second subset of the selected audio signals to generate a second enhanced audio signal;

select one of the first enhanced audio signal or the second enhanced audio signal as an enhanced audio signal;

generate a first output signal including combining a magnitude of the enhanced audio signal with the first phase; and generate a second output signal including combining the magnitude of the enhanced audio signal with the second phase, wherein the first output signal and the second output signal correspond to an audio zoomed signal.

2. The device of claim 1, wherein the one or more processors are further configured to:

receive the first audio signals from a first plurality of microphones mounted externally to a first earpiece of a headset; and receive the second audio signals from a second plurality of microphones mounted externally to a second earpiece of the headset.

3. The device of claim 2, wherein the one or more processors are configured to apply the spatial filtering based on a zoom direction, a zoom depth, a configuration of the first plurality of microphones and the second plurality of microphones, or a combination thereof.

4. The device of claim 3, wherein the one or more processors are configured to determine the zoom direction, the zoom depth, or both, based on a tap detected via a touch sensor of the headset.

5. The device of claim 3, wherein the one or more processors are configured to determine the zoom direction, the zoom depth, or both, based on a movement of the headset.

6. The device of claim 1, wherein the one or more processors are integrated into a headset.

7. The device of claim 1, wherein the one or more processors are further configured to:

provide the first output signal to a first speaker of a first earpiece of a headset; and provide the second output signal to a second speaker of a second earpiece of the headset.

8. The device of claim 1, wherein the one or more processors are further configured to decode audio data of a playback file to generate the first audio signals and the second audio signals.

9. The device of claim 8, wherein the audio data includes position information indicating positions of sources of each of the first audio signals and the second audio signals, and wherein the one or more processors are configured to apply the spatial filtering based on a zoom direction, a zoom depth, the position information, or a combination thereof.

10. The device of claim 8, wherein the audio data includes a multi-channel audio representation of one or more audio sources, and wherein the one or more processors are configured to apply the spatial filtering based on a zoom direction, a zoom depth, the multi-channel audio representation, or a combination thereof.

11. The device of claim 10, wherein the multi-channel audio representation corresponds to ambisonics data.

12. The device of claim 1, further comprising a modem coupled to the one or more processors, the modem configured to provide audio data to the one or more processors based on received streaming data, wherein the one or more processors are configured to decode the audio data to generate the first audio signals and the second audio signals.

13. The device of claim 1, wherein the one or more processors are integrated into a vehicle, and wherein the one or more processors are configured to:

apply the spatial filtering based on a first location of a first occupant of the vehicle; and provide the first output signal and the second output signal to a first speaker and a second speaker, respectively, to play out the audio zoomed signal to a second occupant of the vehicle.

14. The device of claim 13, wherein the one or more processors are configured to:

position a movable mounting structure based on the first location of the first occupant; and receive the first audio signals and the second audio signals from a plurality of microphones mounted on the movable mounting structure.

15. The device of claim 14, wherein the movable mounting structure includes a rearview mirror.

16. The device of claim 14, wherein the one or more processors are configured to apply the spatial filtering based on a zoom direction, a zoom depth, a configuration of the plurality of microphones, a head orientation of the second occupant, or a combination thereof.

17. The device of claim 16, wherein the zoom direction, the zoom depth, or both, are based on the first location of the first occupant.

18. The device of claim 16, further comprising an input device coupled to the one or more processors, wherein the one or more processors are configured to receive, via the input device, a user input indicating the zoom direction, the zoom depth, the first location of the first occupant, or a combination thereof.

19. The device of claim 1, wherein the magnitude of the enhanced audio signal is combined with the first phase based on a first magnitude of the first audio signal and a second magnitude of the second audio signal.

20. The device of claim 1, wherein the magnitude of the enhanced audio signal is combined with the second phase based on a first magnitude of the first audio signal and a second magnitude of the second audio signal.

21. The device of claim 1, wherein the audio zoomed signal includes a binaural audio zoomed signal.

22. The device of claim 1, wherein the one or more processors are configured to apply the spatial filtering based on a zoom direction, a zoom depth, or both.

23. The device of claim 22, wherein the one or more processors are configured to receive a user input indicating the zoom direction, the zoom depth, or both.

24. The device of claim 22, further comprising a depth sensor coupled to the one or more processors, wherein the one or more processors are configured to:

receive a user input indicating a zoom target;

receive sensor data from the depth sensor; and determine, based on the sensor data, the zoom direction, the zoom depth, or both, of the zoom target.

25. The device of claim 24, wherein the depth sensor includes an image sensor, wherein the sensor data includes image data, and wherein the one or more processors are configured to perform image recognition on the image data to determine the zoom direction, the zoom depth, or both, of the zoom target.

26. The device of claim 24, wherein the depth sensor includes an ultrasound sensor, a stereo camera, a time-of-flight sensor, an antenna, or a combination thereof.

27. The device of claim 24, wherein the depth sensor includes a position sensor, wherein the sensor data includes position data indicating a position of the zoom target, and wherein the one or more processors are configured to determine the zoom direction, the zoom depth, or both, of the zoom target based on the position of the zoom target.

28. The device of claim 22, wherein the one or more processors are configured to determine the zoom depth including:

applying the spatial filtering to the selected audio signals based on the zoom direction and a first zoom depth to generate the first enhanced audio signal;

applying the spatial filtering to the selected audio signals based on the zoom direction and a second zoom depth to generate the second enhanced audio signal; and based on determining that a first energy of the first enhanced audio signal is less than or equal to a second energy of the second enhanced audio signal, selecting the first enhanced audio signal as the enhanced audio signal and the first zoom depth as the zoom depth.

29. The device of claim 28, wherein applying the spatial filtering based on the zoom direction and the first zoom depth includes applying the spatial filtering based on a first set of directions of arrival, and wherein applying the spatial filtering based on the zoom direction and the second zoom depth includes applying the spatial filtering based on a second set of directions of arrival.

30. The device of claim 22, wherein the one or more processors are configured to select the selected audio signals based on the zoom direction, the zoom depth, or both.

31. The device of claim 1, wherein the one or more processors are configured to the enhanced audio signal based on determining that a first energy of the enhanced audio signal is less than or equal to a second energy of the other of the first enhanced audio signal or the second enhanced audio signal.

32. The device of claim 1, wherein the one or more processors are configured to apply the spatial filtering to one of the first subset or the second subset with head shade effect correction.

33. The device of claim 1, wherein the first phase is indicated by first phase values, and wherein each of the first phase values represents a phase of a particular frequency subband of the first audio signal.

34. The device of claim 1, wherein the one or more processors are configured to generate each of the first output signal and the second output signal based at least in part on a first magnitude of the first audio signal, wherein the first magnitude is indicated by first magnitude values, and wherein each of the first magnitude values represents a magnitude of a particular frequency subband of the first audio signal.

35. The device of claim 1, wherein the magnitude of the enhanced audio signal is indicated by third magnitude values, and wherein each of the third magnitude values represents a magnitude of a particular frequency subband of the enhanced audio signal.

* * * * *